US009061733B1

(12) United States Patent
Mackro

(10) Patent No.: US 9,061,733 B1
(45) Date of Patent: Jun. 23, 2015

(54) SECTIONAL WATERCRAFT

(71) Applicant: Douglas V. Mackro, Higganum, CT (US)

(72) Inventor: Douglas V. Mackro, Higganum, CT (US)

( * ) Notice: Subject to any disclaimer, the term of this patent is extended or adjusted under 35 U.S.C. 154(b) by 107 days.

(21) Appl. No.: 13/750,059

(22) Filed: Jan. 25, 2013

Related U.S. Application Data

(60) Provisional application No. 61/591,529, filed on Jan. 27, 2012, provisional application No. 61/599,085, filed on Feb. 15, 2012.

(51) Int. Cl.
*B63B 7/04* (2006.01)
*B63B 7/00* (2006.01)

(52) U.S. Cl.
CPC ..... *B63B 7/00* (2013.01)

(58) Field of Classification Search
CPC ..... B63B 7/04; B63B 3/08; B63B 7/02; B63B 35/71; B63B 35/7916
USPC ..... 114/77 A, 77 R, 352, 353; 206/499, 514, 206/515; 220/4.01, 4.12, 4.16, 4.17
See application file for complete search history.

(56) References Cited

U.S. PATENT DOCUMENTS

| | | | | | |
|---|---|---|---|---|---|
| 1,578,472 | A * | 3/1926 | Sawyer | 114/352 |
| 1,916,093 | A * | 6/1933 | Cormier | 114/352 |
| 2,040,373 | A * | 5/1936 | Green | 114/352 |
| 2,443,768 | A * | 6/1948 | House | 114/352 |
| 2,650,376 | A * | 9/1953 | Sommer | 114/352 |
| 2,666,933 | A * | 1/1954 | Engensperger | 114/352 |
| 2,919,451 | A * | 1/1960 | Long | 114/352 |
| 2,977,607 | A * | 4/1961 | Roblee | 114/352 |
| 3,996,635 | A * | 12/1976 | Wilkes et al. | 114/352 |
| 4,052,761 | A * | 10/1977 | Rilling | 114/352 |
| 4,800,832 | A * | 1/1989 | Sulimierski | 114/352 |
| 7,854,211 | B2 * | 12/2010 | Rixford | 114/353 |

* cited by examiner

*Primary Examiner* — S. Joseph Morano
*Assistant Examiner* — Anthony Wiest
(74) *Attorney, Agent, or Firm* — Ware, Fressola, Maguire & Barber LLP

(57) ABSTRACT

A full-length watercraft has two or more separable body sections which can be taken apart and packed into a single packed structure having a smaller length. The present invention provides two ways in packing two adjacent body sections. One way is to take apart the two adjacent body sections and turn one of the sections around so that the smaller section can be put inside the larger section. The other way is to release the securing mechanism between the adjacent body sections so that the smaller section can be slid into the larger section. With a packed structure of a smaller length, the watercraft can be put in an automobile or on a cart to be transported.

1 Claim, 25 Drawing Sheets

SECTIONAL WATERCRAFT

CROSS REFERENCES TO RELATED APPLICATIONS

This application claims benefits of U.S. Patent Application No. 61/591,529, filed Jan. 27, 2012 and Patent Application No. 61/599,085, filed Feb. 15, 2012.

FIELD OF THE INVENTION

The present invention relates generally to a watercraft and, more specifically, to a watercraft that has two or more separable sections.

BACKGROUND OF THE INVENTION

A watercraft, such as a boat, kayak, canoe and dinghy, is usually constructed as a single body which is heavy and long. That makes it impractical to transport the watercraft inside an automobile. That is also the reason why most kayaks or canoes are carried on top of an automobile to be transported. Likewise, it is usually inconvenient for an individual to move a long kayak or canoe over a certain distance.

The present invention provides a watercraft that is easier to transport.

SUMMARY OF THE INVENTION

The present invention provides a full-length watercraft which can be taken apart and packed into a single packed structure having a smaller length. In general, the present invention provides two ways in packing two adjacent body sections. One way is to take apart the two adjacent body sections and turn one of the sections around so that the smaller section can be put inside the larger section. The other way is to release the securing mechanism between two adjacent body sections so that the smaller section can be slid into the larger section. When the watercraft has more than two body sections, it is also possible to slide smaller sections into adjacent larger sections without taking apart those body sections. It is possible to slide the sections with motors or the like.

Thus, the scope of the present invention is to provide a watercraft having a plurality of separable body sections configured for assembling into a single assembled structure having a first length, and for packing into a packed structure having a second length smaller than the first length, said plurality of separable body sections comprising a first body section and a second body section, the first body section comprising an exterior surface and an interior surface defining a cavity with an opening, wherein the second body section is dimensioned such that at least part of the second body section is locatable inside the cavity of the first body section to form the packed structure.

In one of the embodiments of the present invention, the first body section comprises a first inner end, an opposing first outer end and a first intermediate portion between the first inner end and the first outer end, and the second body section comprises a second inner end, an opposing second outer end and a second intermediate portion between the second inner end and the second outer end, and the second inner end is adjacent to the first inner end when said plurality of separable body sections form the single assembled structure.

In another embodiment of the present invention, the second outer end and at least part of the second intermediate portion are locatable inside the cavity when said plurality of separable body sections form the packed structure.

In yet another embodiment, the second inner end and at least part of the second intermediate portion are locatable inside the cavity when said plurality of separable body sections form the packed structure.

In a different embodiment, the second body section comprises a second exterior surface and a second interior surface defining a second cavity with a second opening, and the first body section comprises a plurality of separable sub-sections, said plurality of separable sub-sections comprising a first sub-section including the first inner end and a part of the first intermediate portion, and a second sub-section including the first outer end and a different part of the first intermediate portion, and wherein the second sub-section is dimensioned for placement into the second cavity of the second body section.

In another embodiment, the first body section comprises a plurality of separable sub-sections, said plurality of separable sub-sections comprising a first sub-section including the first inner end and a part of the first intermediate portion, and a second sub-section including the first outer end and a different part of the first intermediate portion, and the cavity comprises an inner cavity adjacent to the second sub-section, and wherein at least part of the second sub-section is dimensioned for placement into the inner cavity.

In some embodiments, the first body section comprises a first sub-section including the first outer end and a second sub-section including the second outer end, and the second body section comprises a third sub-section including the second inner end and a fourth sub-section including the second outer end, wherein the third sub-section is dimensioned such that at least part of the third sub-section is locatable inside the second sub-section, at least part of the first sub-section is locatable inside the third sub-section, and at least part of the fourth sub-section is locatable inside the first sub-section for forming the packed structure.

In some embodiments, the first body section comprises a first sub-section including the first outer end and a second sub-section including the second outer end, and the second body section comprises a third sub-section including the second inner end and a fourth sub-section including the second outer end, wherein each of the first, second, third and fourth sub-sections has a smaller end and an opposing larger end, and wherein the first, second, third and fourth sub-sections are dimensioned for forming the packed structure such that the smaller end of each of the first sub-section, the second sub-section and the third sub-section is adjacent to the smaller end of the fourth sub-section.

In one embodiment, the first body section comprises a first sub-section including the first outer end, a third sub-section including the first inner end, and a second sub-section between the first sub-section and the third sub-section, and the second body section comprises a fourth sub-section including the second inner end and a fifth sub-section including the second outer end, wherein the third sub-section comprises a cavity with a first opening adjacent to first inner end and an opposing second opening adjacent to the second sub-section, wherein the second sub-section is dimensioned for sliding into one part of the third sub-section through the second opening, the first sub-section is dimensioned for sliding into second sub-section, and wherein the fourth sub-section is dimensioned for sliding into another part of the third sub-section through the first opening, and the fifth sub-section is dimensioned for sliding into the fourth sub-section for forming the packed structure.

In various embodiments, the watercraft also has a locking assembly configured for securing the first inner end to the second inner end when said plurality of separable body sections form the single assembled structure, and a sealing part located between the first inner end and the second inner end for preventing water leakage into the interior of the watercraft when said plurality of separable body sections form the single assembled structure.

The present invention will become apparent upon reading the description taken in conjunction with the drawings as shown in FIGS. 1-20*g*.

DETAILED DESCRIPTION OF THE INVENTION

The present invention provides a full-length watercraft which can be taken apart and packed into a single packed structure having a smaller length. As such, the watercraft can be put in an automobile or on a cart to be transported. According to various embodiments of the present invention, the watercraft has two or more separable body sections which can be secured into a single assembled structure and can be packed into a packed structure having a smaller length. In general, the present invention provides two ways in packing two adjacent body sections. One way is to take apart the two adjacent body sections and turn one of the sections around so that the smaller section can be put inside the larger section. The other way is to release the securing mechanism between the adjacent body sections so that the smaller section can be slid into the larger section.

In the various embodiments of the present invention, the watercraft can be a boat, a kayak, a canoe or the like. In case of a kayak, it can be a sit-on-top kayak or a conventional kayak that has one or two cockpits to allow one or more persons to sit in the cockpits.

Figure 1:
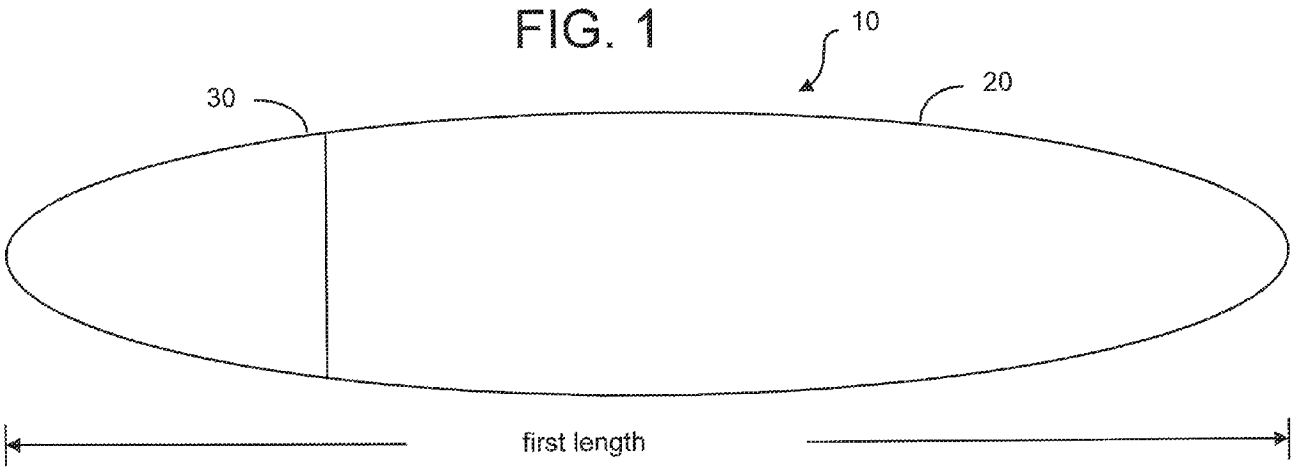
FIG. 1 shows a watercraft in a single, assembled structure, according to one embodiment of the present invention.
Figure 2:
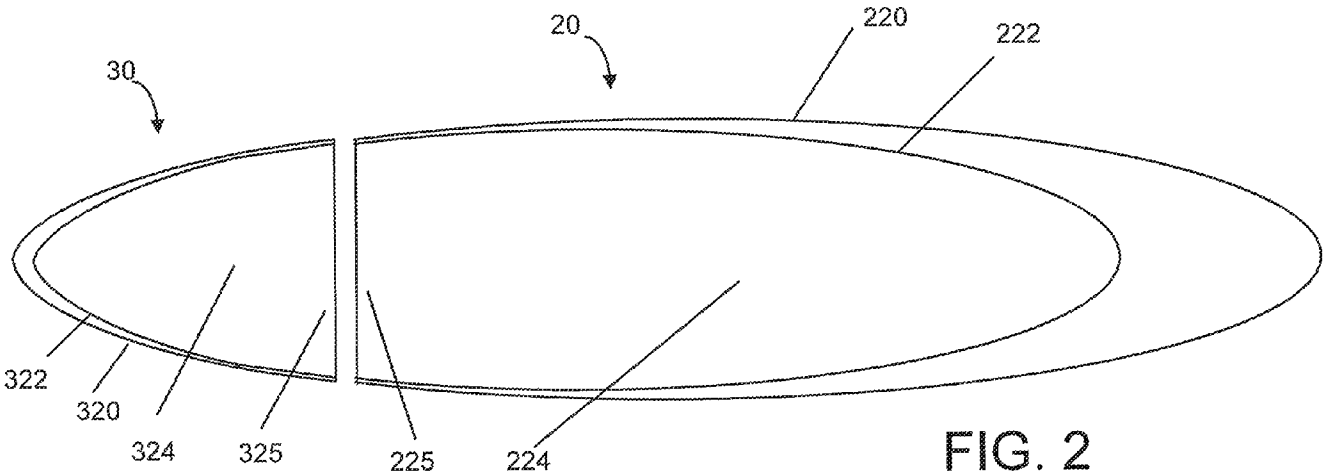
FIG. 2 shows the general construction of a watercraft as shown in FIG. 1.
Figure 3:
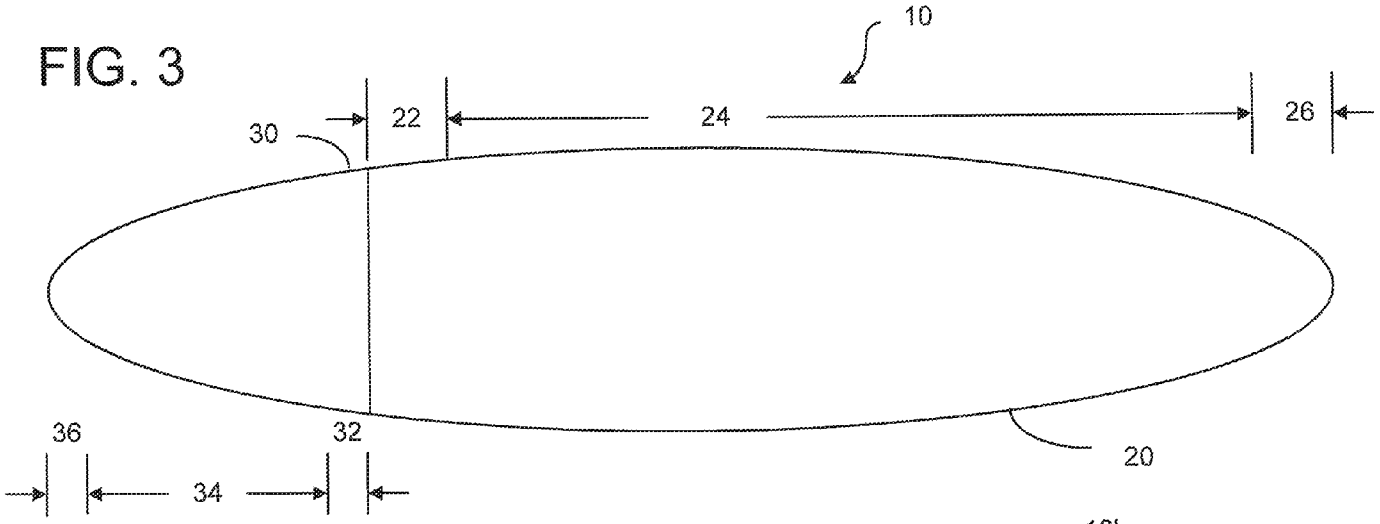
FIG. 3 shows various portions of a section in a sectional watercraft, according to the present invention.
Figure 4A:
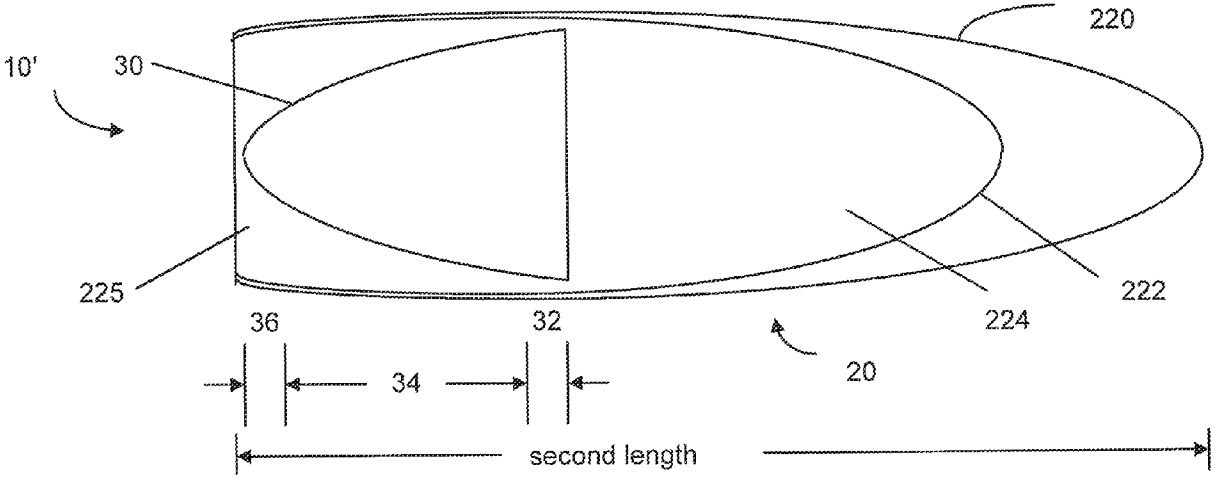
FIG. 4*a* shows how the sectional watercraft as depicted in FIGS. 2 and 3 is packed into a packed structure, according to one embodiment of the present invention.
Figure 4B:
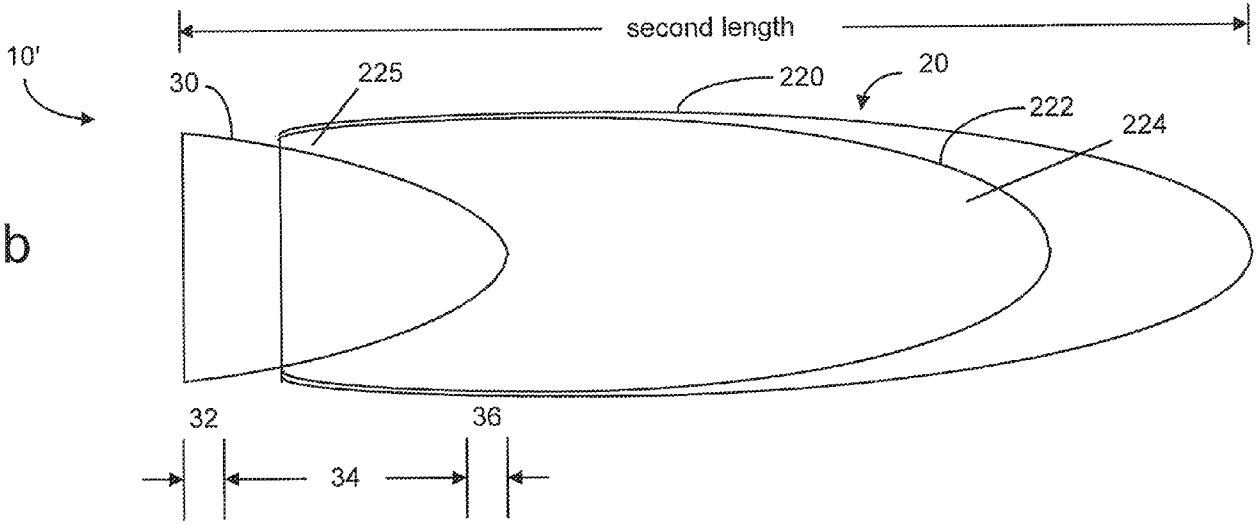
FIG. 4*b* shows how the sectional watercraft as depicted in FIGS. 2 and 3 is packed into another packed structure, according to a different embodiment of the present invention.

In one of the embodiments of the present invention, a watercraft has two separable body sections as shown in FIG. 1. As shown in FIG. 1, the watercraft 10 has a first body section 20 and a second body section 30 to be assembled into a single assembled structure having a full length. As can be seen in FIGS. 2 and 3, the first body section 20 has an exterior surface 220 and an interior surface 222 defining a cavity 224 with an opening 225. The second body section 30 has an exterior surface 320 and an interior surface 322 defining a cavity 324 with an opening 325. The second body section 30 is dimensioned such that at least part of the second body section 30 is locatable inside the cavity 224 of the first body section to form the packed structure, as shown in FIGS. 4*a* and 4*b*.

As shown in FIG. 3, the first body 20 has a first inner end 22, an opposing first outer end 26 and a first intermediate portion 24 between the first inner end and the first outer end. The second body section 30 has a second inner end 32, an opposing second outer end 36 and a second intermediate portion 34 between the second inner end and the second outer end. The second inner end 32 of the second body section 30 is adjacent to the first inner end 22 of the first body section when these body sections form the single assembled structure.

As mentioned earlier, there are two ways to pack the separable body sections into a packed size, depending on how the two adjacent body sections are joined. In the embodiment as shown in FIG. 4*a*, after the securing mechanism (not shown) between the first body section 20 and the second body section 30 is released, the smaller section 30 is slid into the larger section 20 through the opening 225. In the embodiment as shown in FIG. 4*b*, the two adjacent body sections 20 and 30 are taken apart and one of the sections are turned around so that the smaller section 30 can be put, at least partly, inside the larger section 20 through the opening 225. As can be seen from FIGS. 4*a* and 4*b*, the length of the packed structure 10' is smaller than the length of a single assembled watercraft 10 as shown in FIG. 1.

Figure 5:
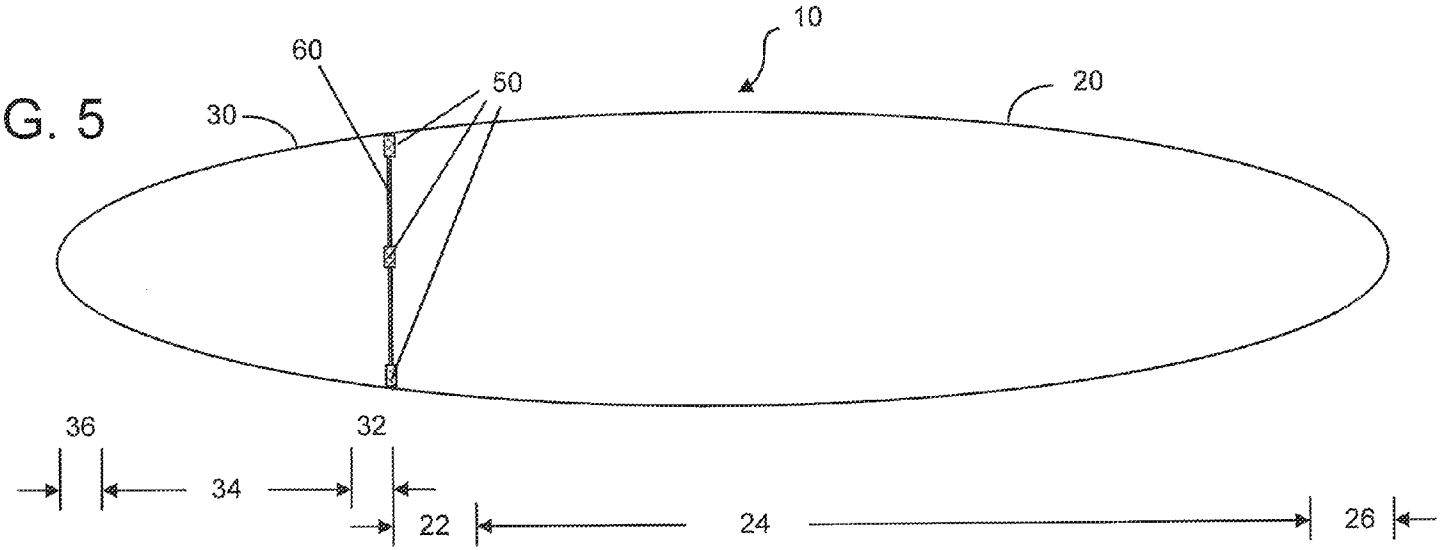
FIG. 5 is a schematic representation of a sealing component and a locking assembly for assembling the sectional watercraft into a single assembled structure.
Figure 7:
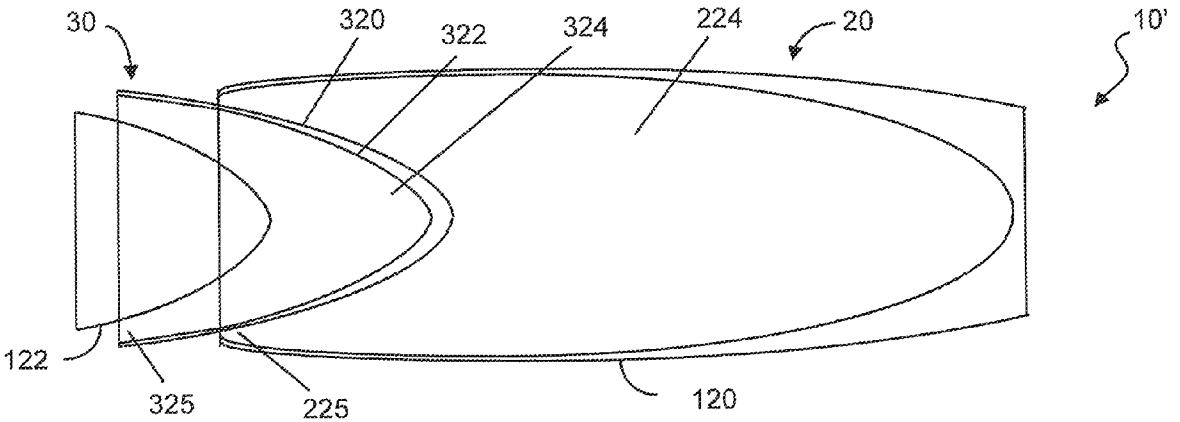
FIG. 7 shows how the three sections are packed into a packed structure, according to one embodiment of the present invention.
Figure 13A:
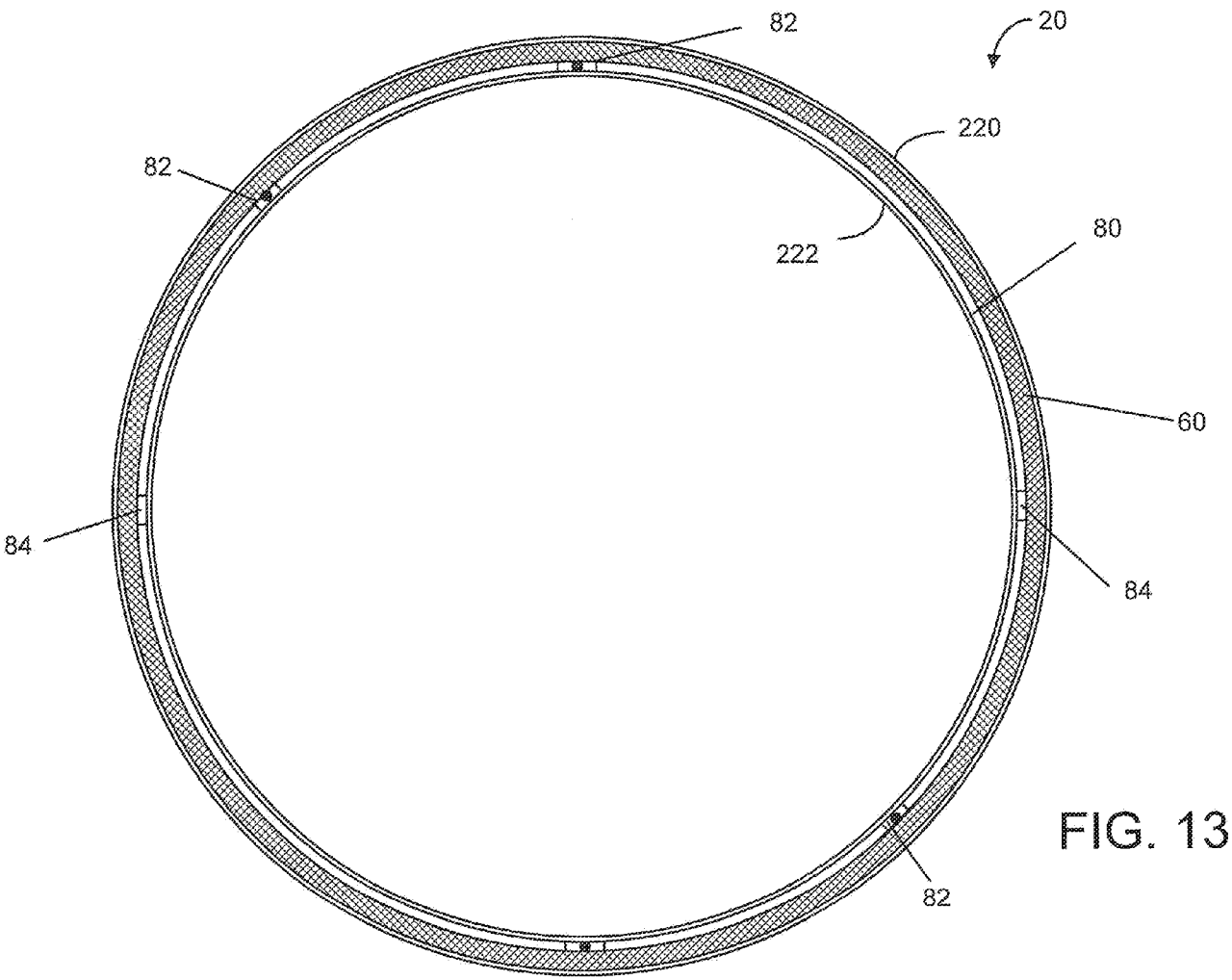
FIG. 13*a* shows the sealing part on one of the adjacent body sections where the cross section of the body section is a complete loop.
Figure 13B:
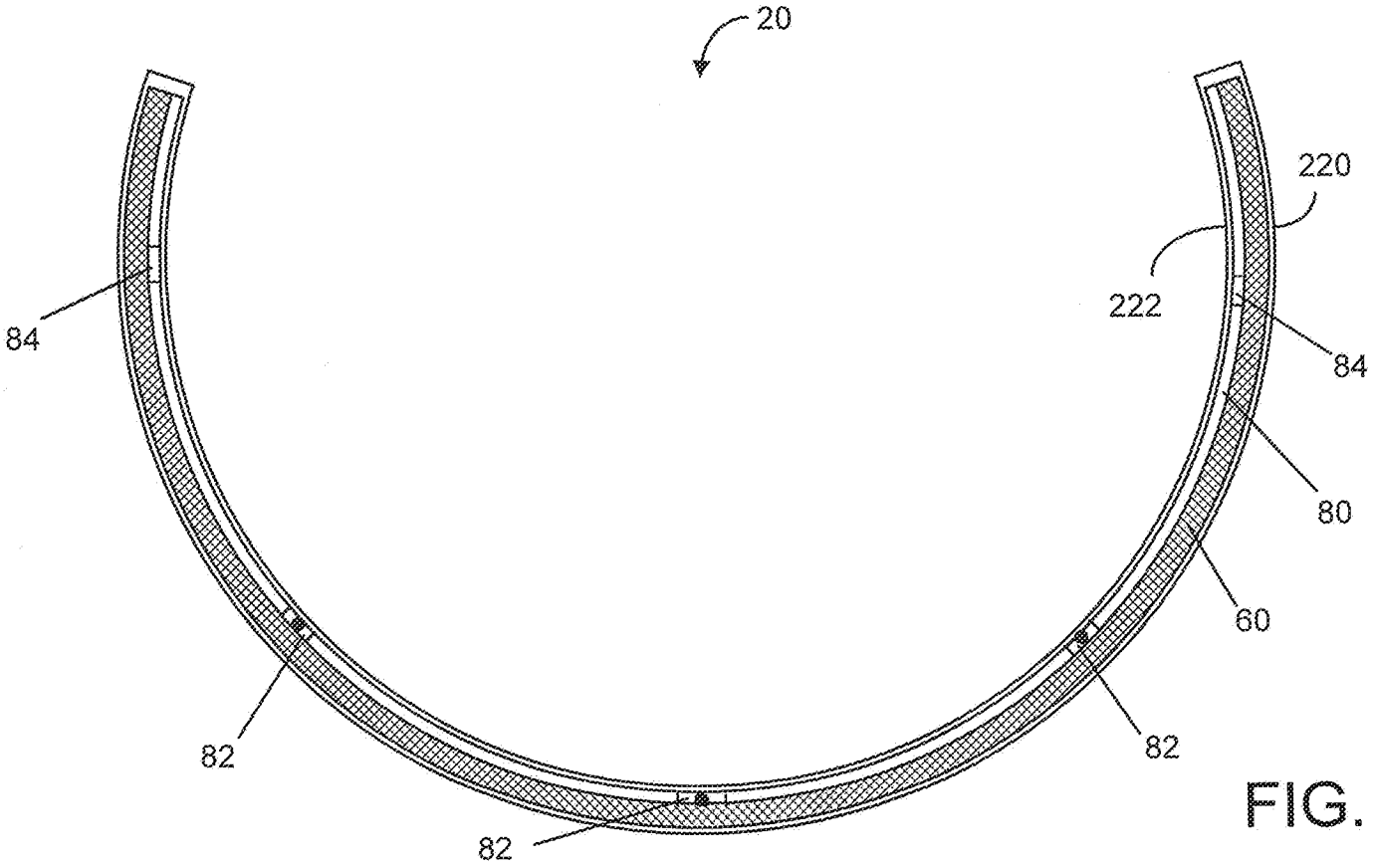
FIG. 13*b* shows the sealing part on one of the adjacent body sections where the cross section of the body section is only a partial loop.

In order to secure two adjacent body sections together, a certain locking assembly has to be provided. In order to prevent water from leaking into the interior of the watercraft, a certain sealing part has to be provided. As shown in FIG. 5, a locking assembly 50 is provided for securing the first inner end 22 to the second inner end 32 and a sealing part 60 located between the first inner end 22 and the second inner end 32 is used for preventing water leakage into interior of the watercraft when the separable body sections 20, 30 form the single assembled watercraft 10. An exemplary locking assembly and sealing part is illustrated in FIGS. 13*a* and 13*b*.

Figure 6:
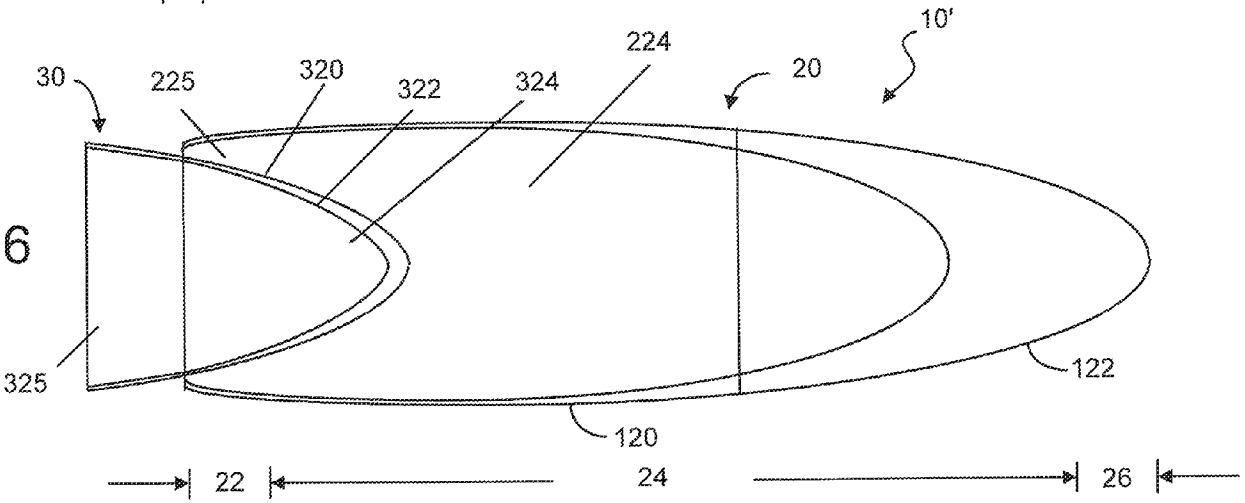
FIG. 6 shows a watercraft having three separable sections.

In one embodiment of the present invention, the watercraft has three separable body sections which can be packed into a packed size. As shown in FIG. 6, the first body section 20 has a first sub-section 120 and a second sub-section 122. The first sub-section 120 includes the first inner end 22 and a part of the first intermediate portion 24. The second sub-section 122 includes the first outer end 26 and a different part of the first intermediate portion 24. In this embodiment, the second sub-section 122 is smaller than the second body section 30 such that the second sub-section 122 can be placed, at least partly, into the second cavity 324 of the second body section 30 through the opening 325.

Figure 8:
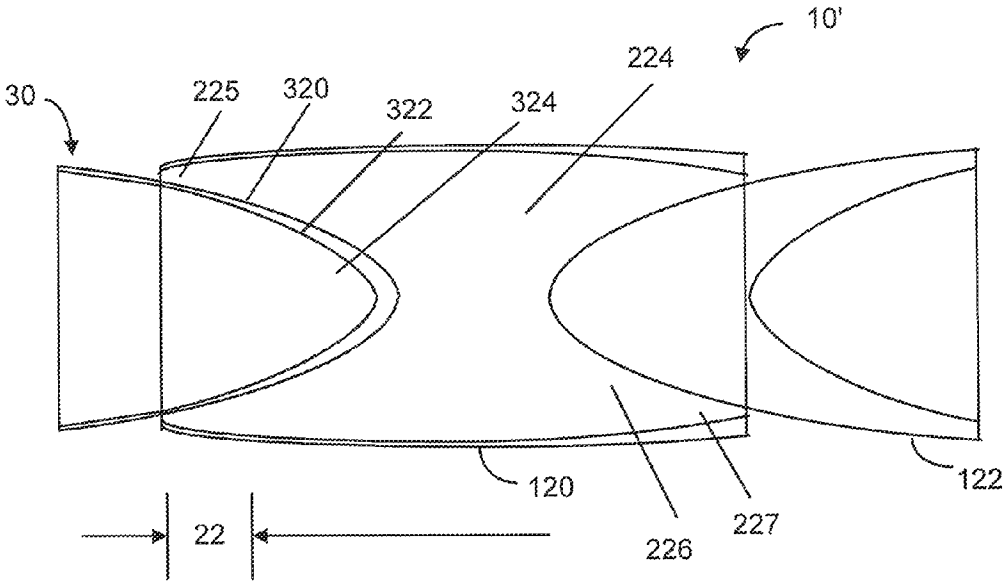
FIG. 8 shows how the three sections are packed into a different packed structure, according to another embodiment of the present invention.

In a different embodiment, the first body section 20 is sectioned into two sub-sections differently. As shown in FIG. 8, the first sub-section 120 has now two openings 225 and 227 defined by the inner cavity 226. Before the first sub-section 120 and the second sub-section 122 are separated, the inner cavity 226 is adjacent to the second sub-section 122. In this embodiment, at least part of the second sub-section 122 is dimensioned to be placed into the inner cavity 226 through the opening 227.

Figure 9:
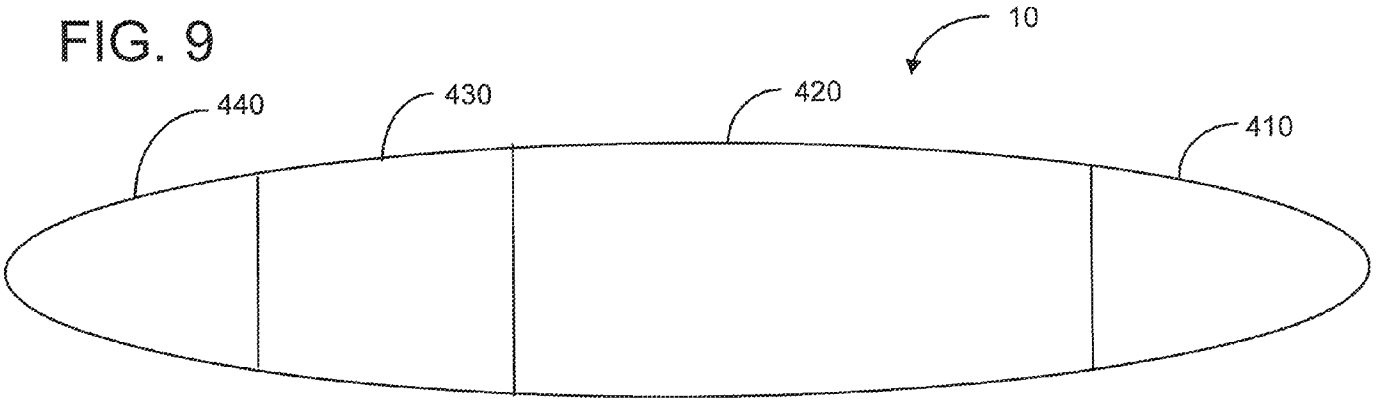
FIG. 9 shows a watercraft having four separable sections assembled in a single assembled structure.
Figure 10A:
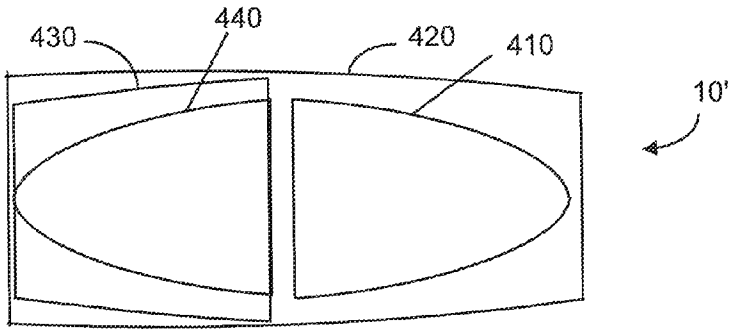
FIGS. 10*a*-10*h* show different ways to pack the four sections in the watercraft of FIG. 9 into a packed structure.
Figure 10B:
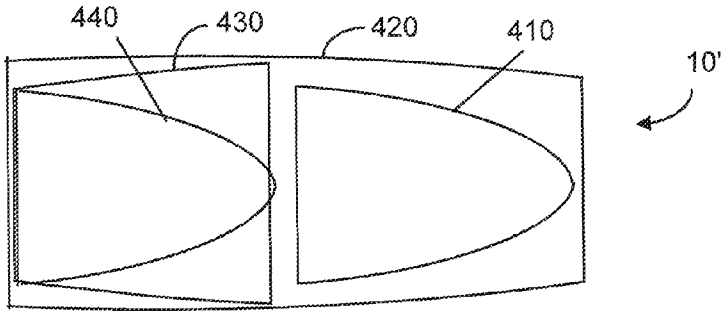
Figure 10C:
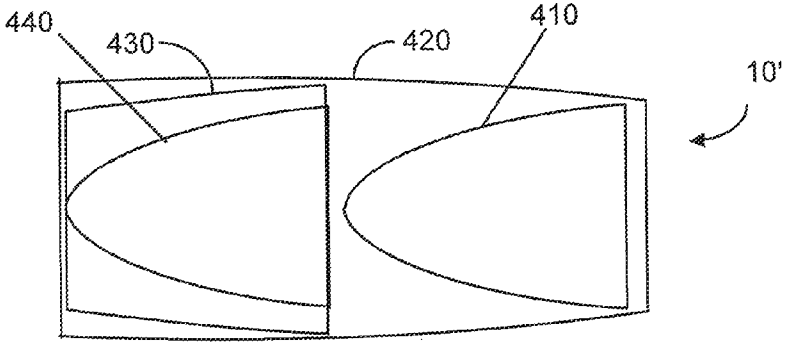
Figure 10D:
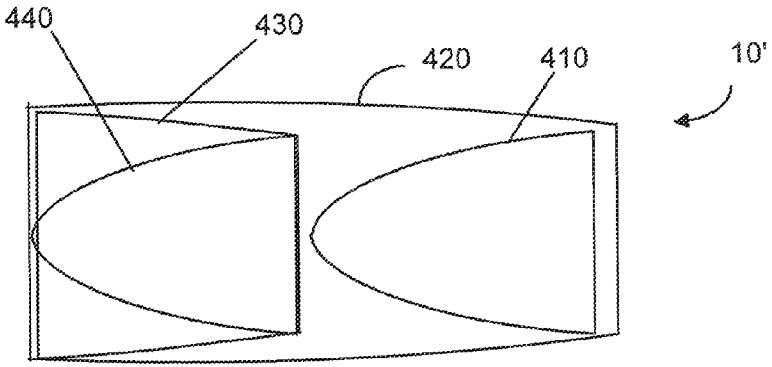
Figure 10E:
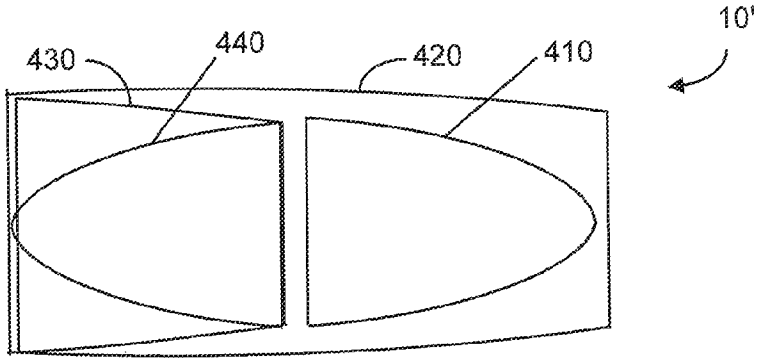
Figure 10F:
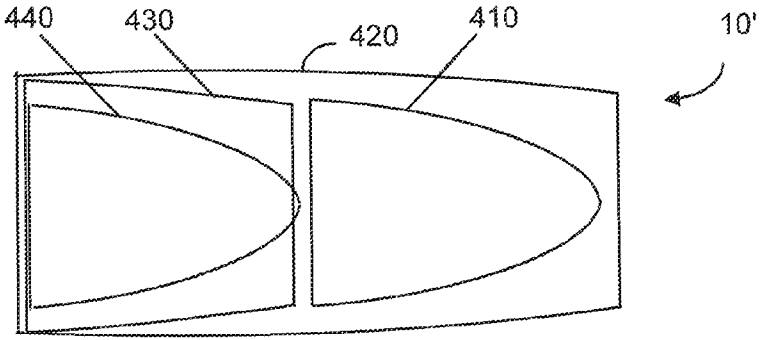
Figure 10G:
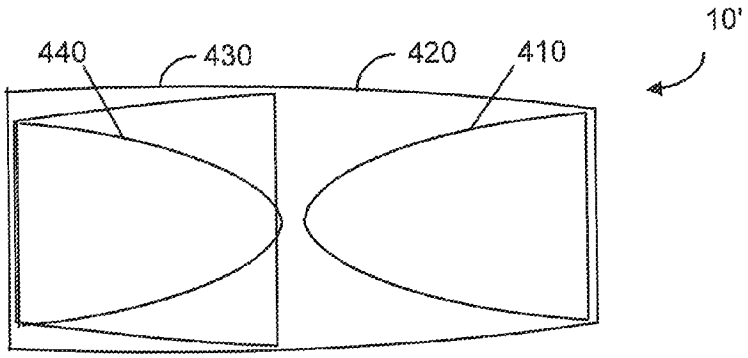
Figure 10H:
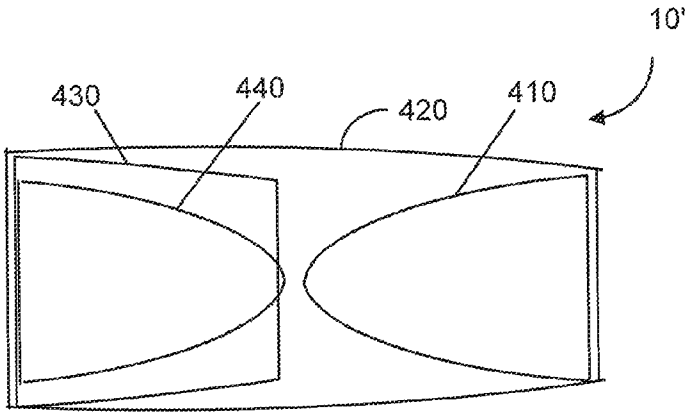

In another embodiment, the watercraft 10 comprises four separable body sections 410, 420, 430 and 440 as shown in FIG. 9. After the locking assembly (not shown) between two adjacent body sections is released, the four body sections can be packed into a packed structure 10' in many different ways. As shown in FIG. 10*a*, the first body section 410 is slid into one end of the second body section 420. Furthermore, the third body section 430 is slid into the other end of the second body section 420 and the fourth body section 440 is slid into the third body section 430. In the embodiment as shown in FIG. 10*b*, after the fourth body section 440 is separated from the third body section 430, the fourth body section 440 is turned around before it is placed inside the third body section 430. In the embodiment as shown in FIG. 10*c*, after the first body section 410 is separated from the second body section 420, the first body section 410 is turned around before it is placed inside the second body section 420. In the embodiment as shown in FIG. 10*d*, after the first body section 410 is separated from the second body section 420, the first body section 410 is turned around before it is placed inside the second body section 420. Furthermore, after the fourth body section 440 is separated from the third body section 430, the fourth body section 440 is turned around before it is placed inside the third body section 430. In the embodiment as shown in FIG. 10*e*, after the locking assembly between two adjacent body sections in released, only the third body section 430 is turned around for packing. In the embodiment as shown in FIG. 10*f*, after the locking assembly between two adjacent body sections in released, both the third body section 430 and the fourth body section 440 are turned around for packing. In the embodiment as shown in FIG. 10*g*, after the locking assembly between two adjacent body sections in released, the first body section 410 and the fourth body section 440 are turned around for packing. In the embodiment as shown in FIG. 10*h*, the first body section 410, the third body section 430 and the fourth 440 are turned around for packing.

Figure 11A:
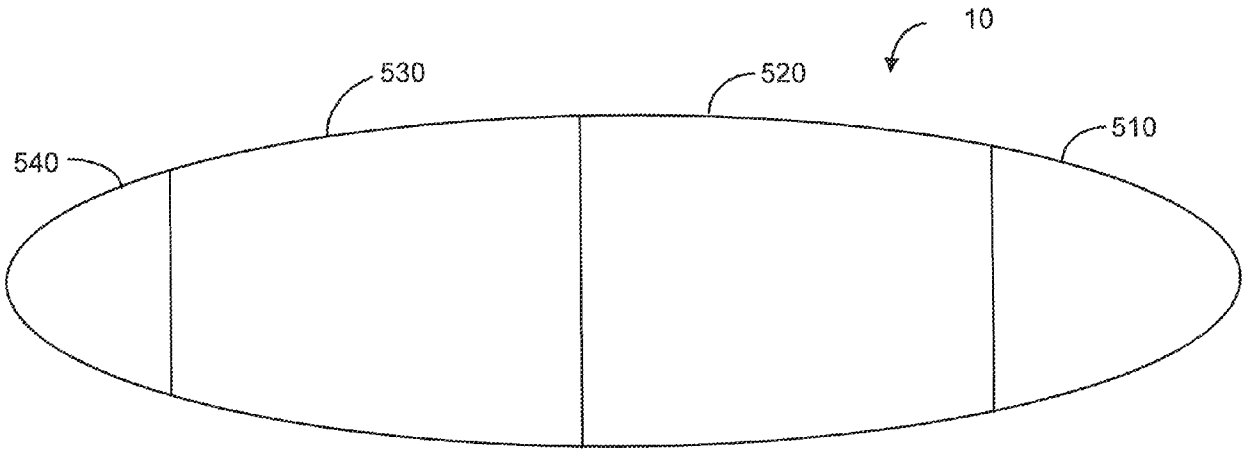
FIG. 11*a* shows a different watercraft having four sections.
Figure 11B:
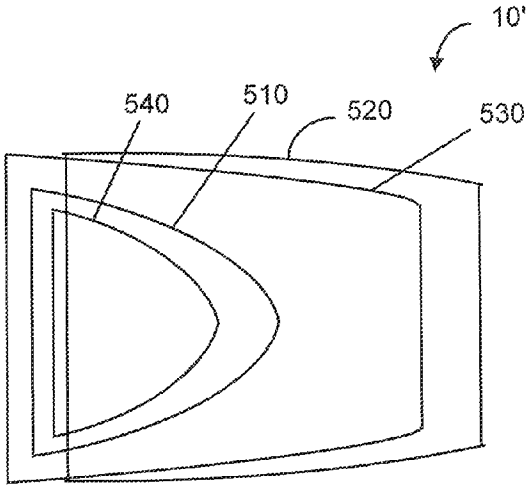
FIG. 11*b* shows one way for packing the four sections in the watercraft of FIG. 11*a* into a packed structure.

In yet another embodiment of the present invention, the watercraft 10 comprises four separable body sections 510, 520, 530 and 540 as shown in FIG. 11*a*. After the locking assembly (not shown) between two adjacent body sections is released, all body sections are taken apart. As shown in FIG. 11*b*, the third body section 530 is turned around before it is placed at least partly into the second body section 520. In this embodiment, the first body section 510 is placed inside the third body section 530 and the fourth body section 540 is placed inside the first body section 510 to become a packed structure 10'.

Figure 12A:
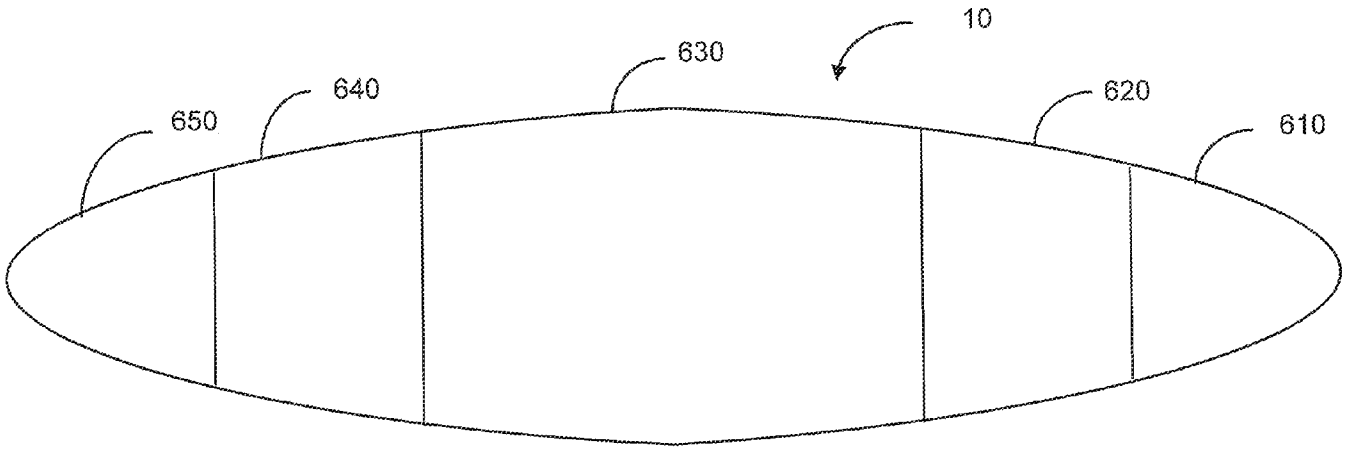
FIG. 12*a* shows a different watercraft having five sections.
Figure 12B:
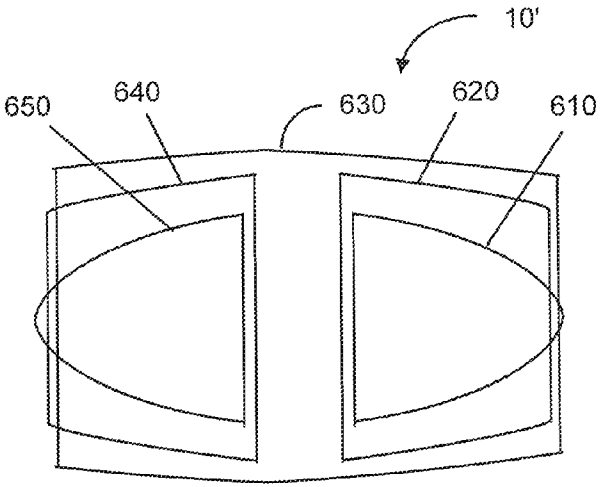
FIG. 12*b* shows one way for packing the five sections in the watercraft of FIG. 12*a* into a packed structure.

In a different embodiment of the present invention, the watercraft 10 comprises five separable body sections 610, 620, 630, 640 and 650 as shown in FIG. 12*a*. After the locking assembly (not shown) between two adjacent body sections is released, the smaller one of the two adjacent body sections is slid into the larger one. As shown in FIG. 12*b*, the second body section 620 is slid into one end of the third body section 630 and the fourth body section 640 is slid into the other end of the third body section 630. Furthermore, the first body section 610 is slid into the second body section 620, and the fifth body section 650 is slid into the fourth body section 640 to form a packed structure 10'. In this embodiment, none of the body sections are turned around relative to the other sections. Furthermore, it would not be necessary to move two adjacent body sections apart from each other, as can be seen in FIG. 14.

In various embodiments of the present invention, the adjacent body sections of a watercraft are separable for packing. Taking the embodiment as shown in FIG. 2 as an example, at least one of the body sections 20, 30 has a sealing part. As shown in FIG. 13*a*, the first body section 20 has a sealing part 60 in the full circumference between the exterior surface 220 and the interior surface 222. Furthermore, a tongue 80 is provided so that it can be joined by a matching part, such as groove, on the second body section 30 (not shown). Furthermore, some gaps 82, 84 are made in the tongue 80 so that the gaps can be joined with corresponding mating parts on the adjacent body section to achieve a positive alignment when the two adjacent body sections are assembled to form the single, assembled structure.

FIG. 13*b* shows the sealing part 60 and the tongue and groove features 80, 82, 84 when the joining area of the body section does not have a full circumference, as in the case of a canoe, or when the sectioning is done at a cockpit of a kayak, for example.

Figure 14:
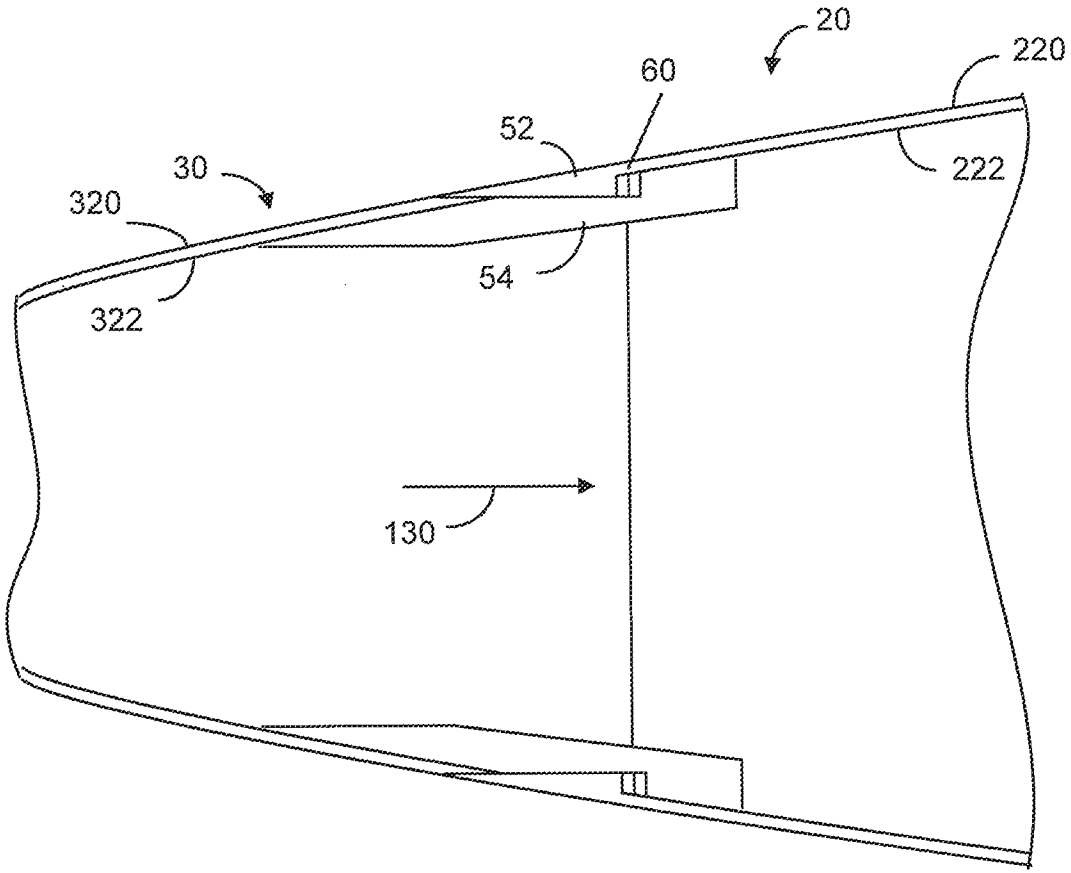
FIG. 14 shows the interface between two adjacent body sections, according to one embodiment of the present invention.

FIG. 14 shows the interface between two adjacent body sections, according to one embodiment of the present invention. As shown in FIG. 14, part of the first body section 20 has a hook-like locking block 52 to be engaged with another hook-like locking block 54 on the second body section 30. Such a design allows the second body section 30 to be slid into the first body section 20 as indicated by the arrow 130. As such, it would not be necessary to move the two adjacent body sections apart when they are packed to form a packed structure. In order to prevent water from leaking into the watercraft through the interface, a sealing part 60 is provided between the two locking blocks 52, 54.

Figure 15A:
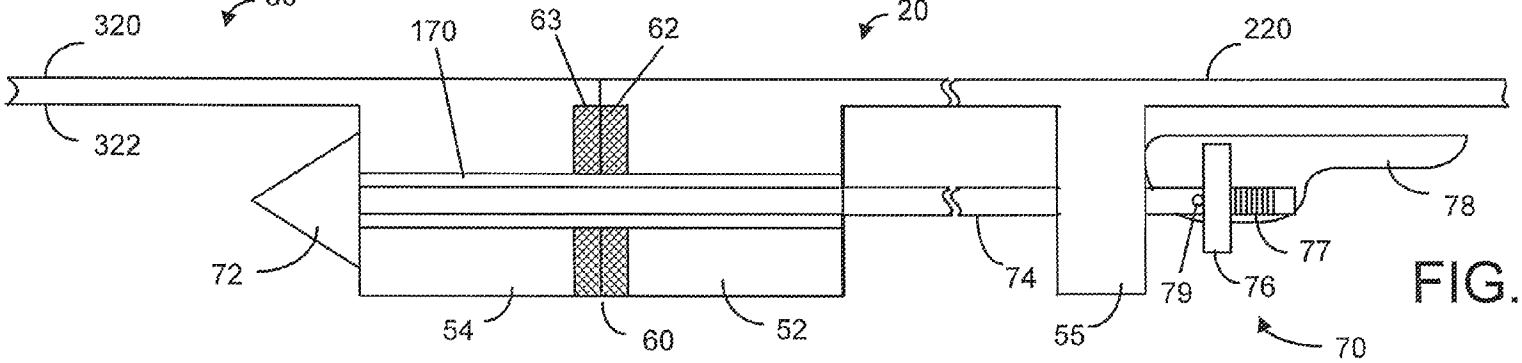
FIGS. 15*a* to 15*c* illustrate a locking assembly for securing two adjacent body sections, according to one embodiment of the present invention.
Figure 15B:
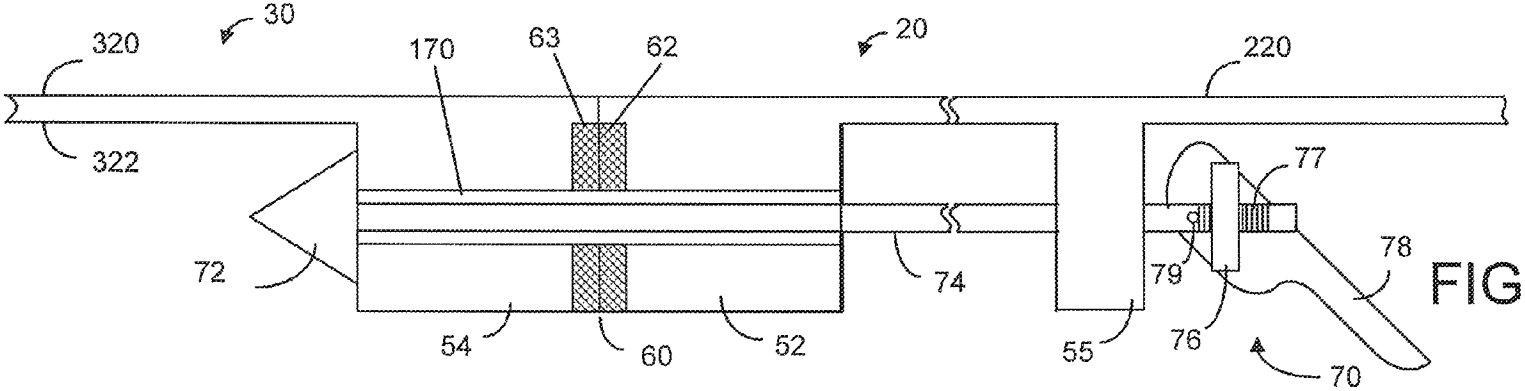
Figure 15C:
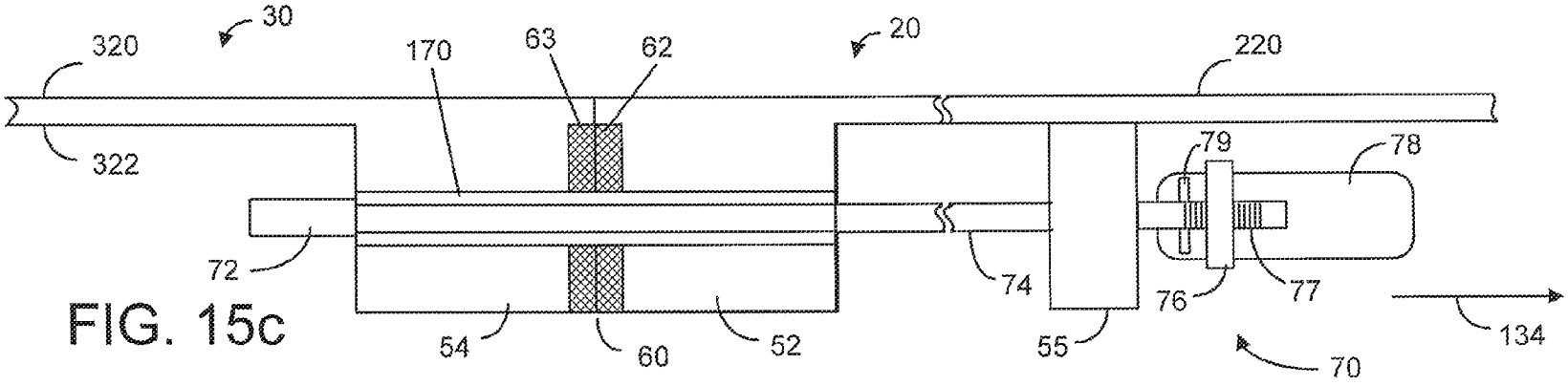

FIGS. 15*a* to 15*c* illustrate a locking assembly for securing two adjacent body sections, according to one embodiment of the present invention. As shown in FIGS. 15*a* to 15*c*, the first body section 20 has a first locking block 52 and the second body section 30 has a second locking block 54. As shown, a channel 170 is provided in the locking blocks 52 and 54. The two locking blocks 52 and 54 can be secured by a cam locking assembly 70. The cam locking assembly 70 comprises a rod 74 with an arrowhead-like locking blade 72 on one end and a cam locking handle 78 with a locking pin or shaft 79 on the other end. The cam locking assembly 70 is operable in three positions. In the first position as shown in FIG. 15*a*, the locking blade 72 is prevented from moving through the channel 170. In this position, a thumbscrew or locknut 76 is engaged with a threaded part 77 of the rod 74 and the locking shaft 79 for securing the first body section 20 to the second body section 30. The cam locking handle 78 provides an urging force against the block 55. In the second position as shown in FIG. 15*b*, with the cam locking handle 78 rotated in a clockwise direction to release the urging force against the block 55, the locknut 76 can be moved away from the locking shaft 79. Now the cam locking handle can be flipped over as shown in FIG. 15*c*. As such, the locking blade 72 is allowed to be retrieved through the channel 170 so that the first body section 20 and the second body section 30 can be separated from each other as indicated by the arrow 134. Furthermore, the entire locking assembly 70, including the locking blade 72, the rod 74, the thumbscrew 76, the locking shaft 79 and the cam locking handle 78, can be separated from the first body section 220, as indicated by the arrow 134. For sealing the gap between two adjacent body sections, a sealing part 60 having two sealing surfaces 62 and 63 is used, for example.

Figure 15D:
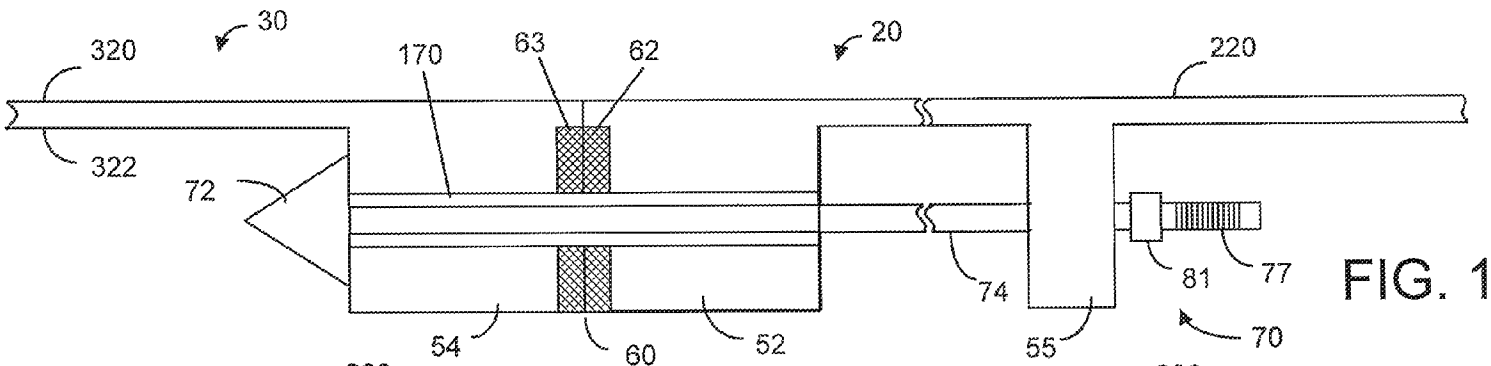
FIGS. 15*d* to 15*h* illustrate a locking assembly for securing two adjacent body sections, according to another embodiment of the present invention.
Figure 15F:
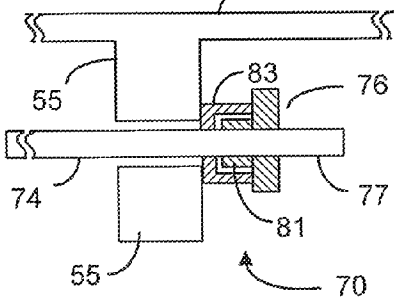
Figure 15H:
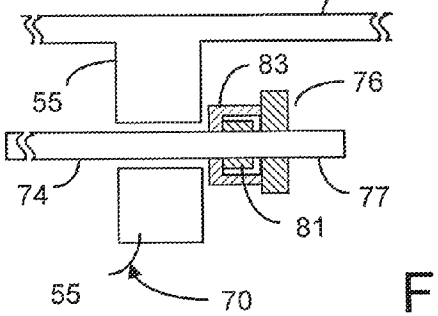
Figure 15E:
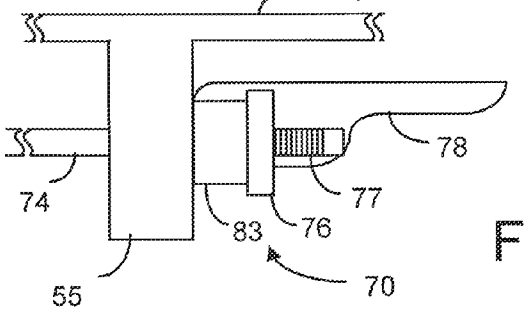
Figure 15G:
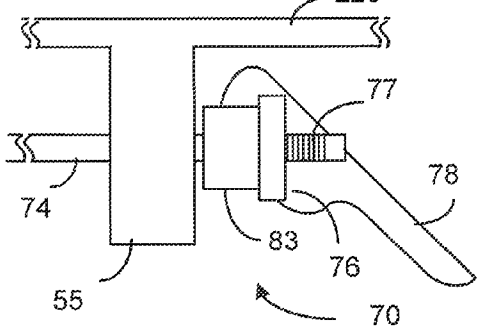
Figure 16:
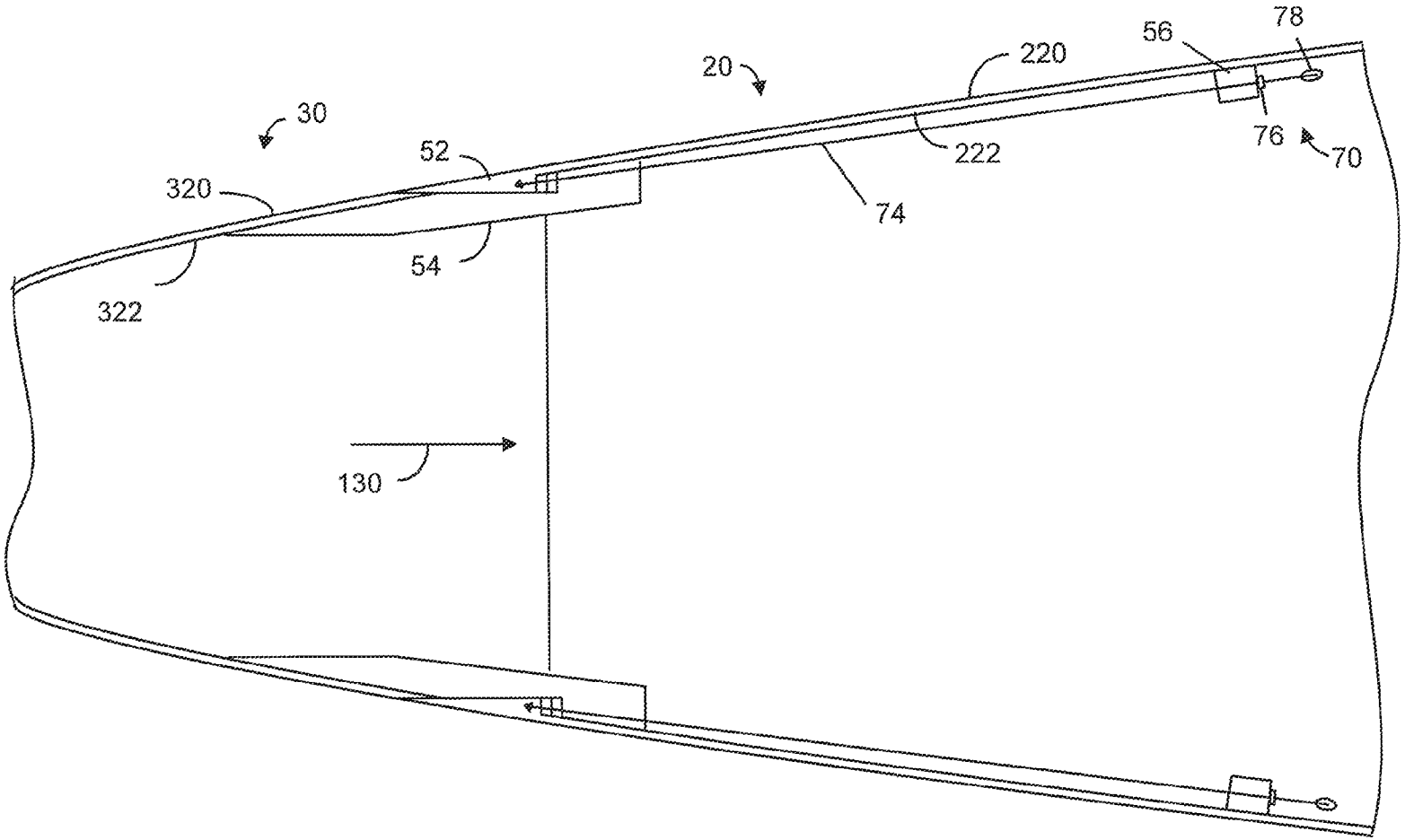
FIG. 16 shows how the locking assembly of FIGS. 15*a* and 15*b* is used at the interface of FIG. 14.

FIGS. 15*d* to 15*h* illustrate a locking assembly for securing two adjacent body sections, according to another embodiment of the present invention. As shown in FIGS. 15*d* to 15*h*, a fixedly attached block 81 and a slideable block 83 are used to replace the locking shaft 79 as shown in FIGS. 15*a* to 15*c*. When the cam locking assembly 70 is in the locking position, the locknut 76 is engaged with the threaded part 77 of the rod 74 to push the slideable block 83 against the block 55. The cam locking handle 78 provides an urging force against the block 55, as shown in FIGS. 15*e* and 15*f*. In the second position as shown in FIGS. 15*g* and 15*h*, with the cam locking handle 78 rotated in a clockwise direction to release the urging force against the block 55, the locknut 76 and the slideable block 83 can be moved away from the block 55. As with the embodiment as shown in FIGS. 15*a* to 15*c*, the cam locking handle can be flipped over to allow the locking blade 72 to be retrieved through the channel 170 so that the first body section 20 and the second body section 30 can be separated from each other as indicated by the arrow 134 (see FIG. 15*c*). It should be noted that the fixedly attached block 81 can be cylindrical (with a round cross section) or polygonal (with a polygonal cross section). Likewise, the inner part of the slideable block 83 can be dimensioned accordingly.

The cam locking assembly 70 can also be used to secure two adjacent body sections as shown in FIG. 14. Now referring to FIGS. 16, and 17*a*-17*e*, the locking blade 72 is engaged with the locking block 52 and the rod 74 is engaged in the locking block 54. In addition, the first body section 20 also has a locking block 56 to be engaged with the thumbscrew 76 for securing the first and second body sections together. As shown in FIGS. 17*a*-17*e*, the locking block 52 on the first body section 20 has a first chamber 152 dimensioned to accommodate the locking blade 72, and the locking block 54 on the second body section 30 has a first chamber 154 dimensioned to accommodate the locking blade 72.

Figure 17A:
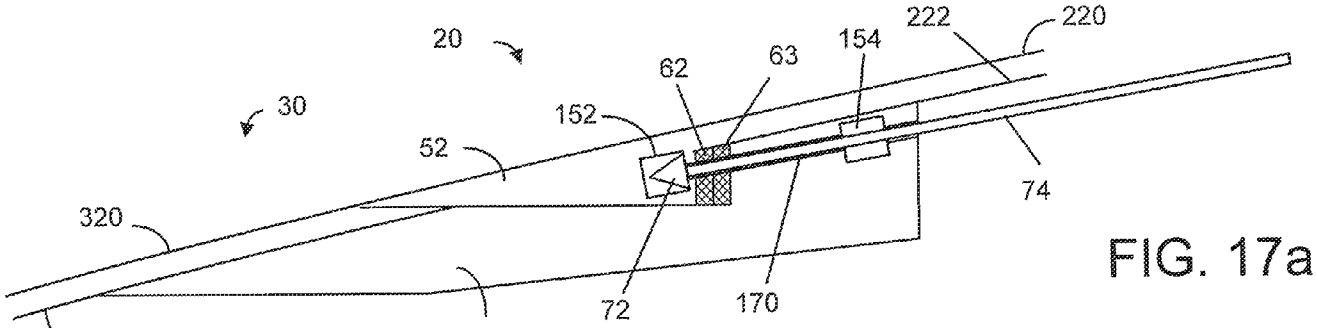
FIGS. 17*a*-17*e* illustrate how the locking assembly is engaged with and released from two adjacent body sections.
Figure 17B:
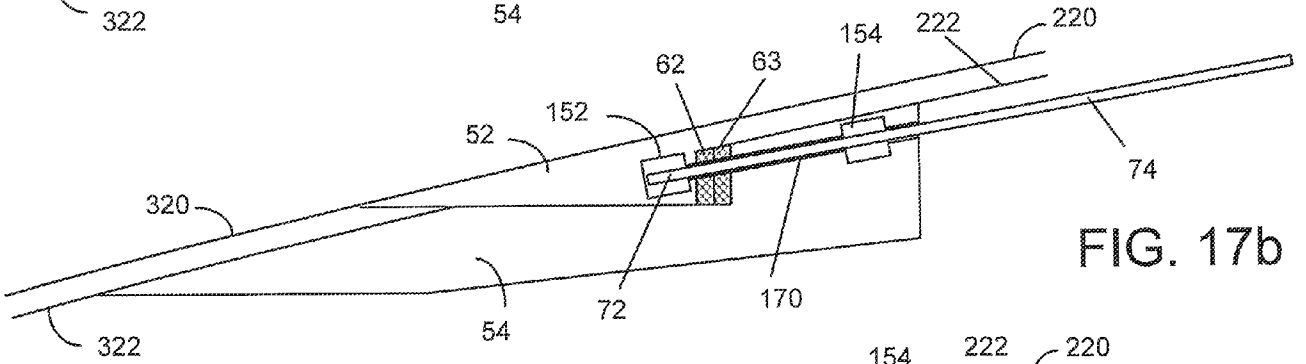
Figure 17C:
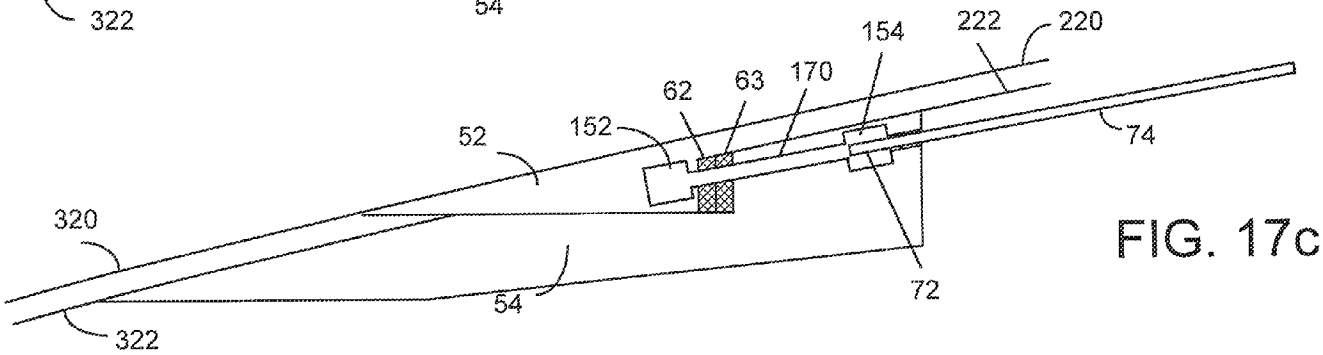
Figure 17D:
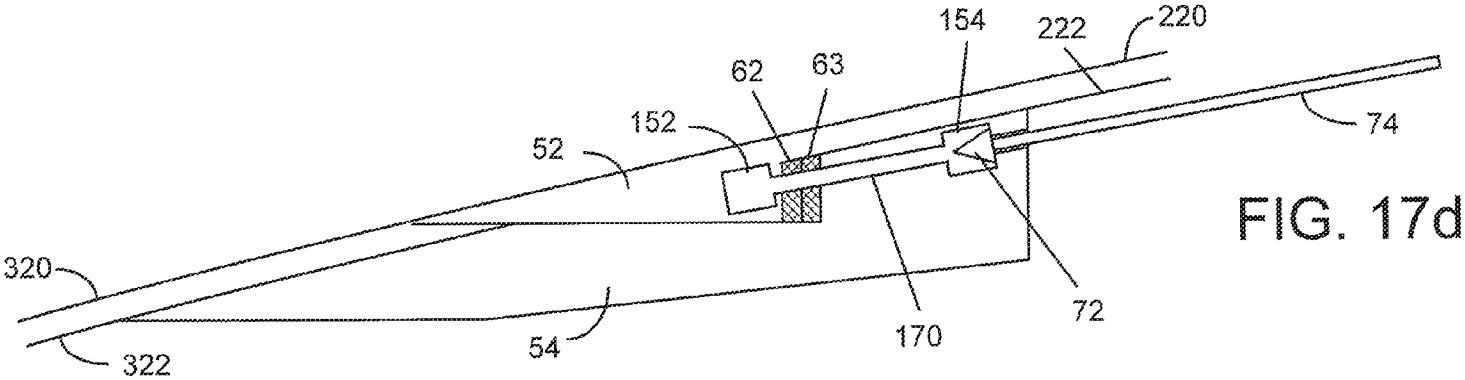
Figure 17E:
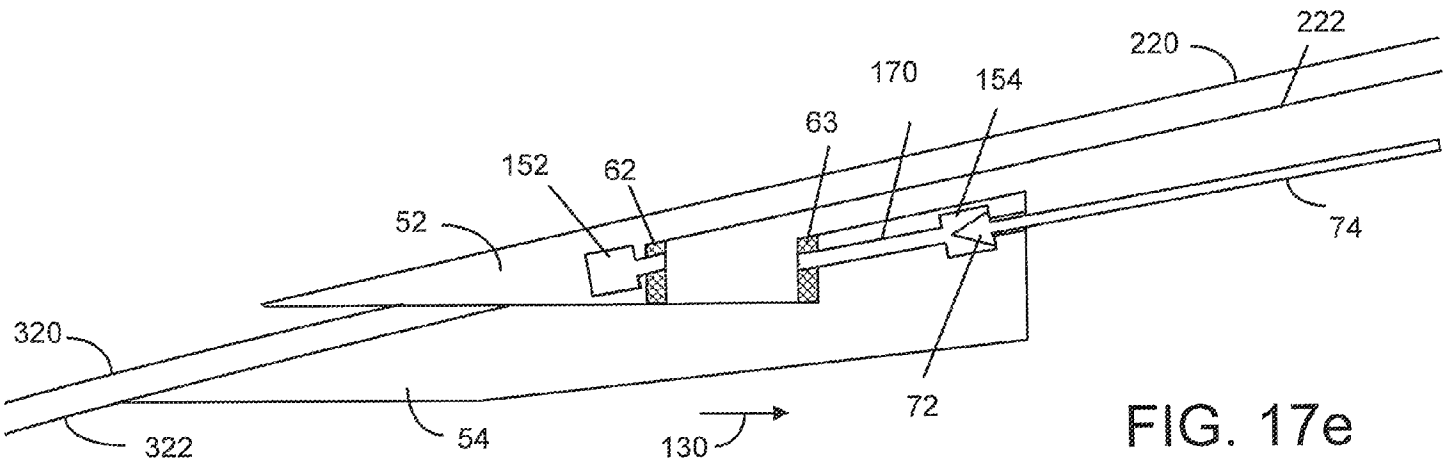

As with the embodiment as shown in FIGS. 15*a* and 15*b*, the cam locking assembly 70 is operable in the first position and in the second position. As shown in FIG. 17*a*, the cam locking assembly is operated in the first position in that the locking blade 72 is prevented from moving out of the first chamber 152 through the channel 170. In this position, a thumbscrew or locknut 76 can be adjusted against the locking block 56 for securing the second body section 30 to the first body section 20 (see FIG. 16). As shown in FIG. 17*b*, the cam locking assembly in the second position in that the locking blade 72 is turned sidewise so that the locking blade 72 is allowed to move out of the first chamber 152 through the channel 170. FIG. 17*c* shows that the locking blade 72 has moved into the second chamber 154. If the cam locking assembly is changed from the second position to the first position as shown in FIG. 17*d*, the locking blade 72 is prevented from moving out of the second chamber 154. As such, it is possible to pull the locking block 54 away from the locking block 52 so that the second body section 30 is moved toward the first body section 20 for packing as indicated by the arrow 130 (see also FIG. 16).

Figure 18:
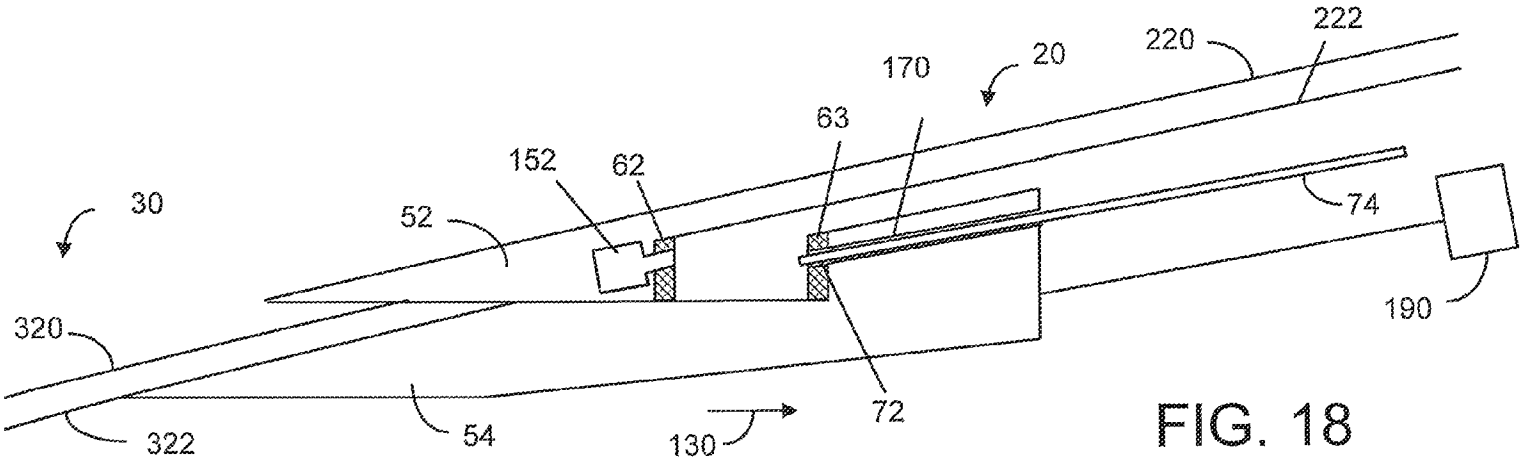
FIG. 18 shows a movement mechanism used to move one of the locking blocks.

It should be noted that the separation of the various body sections and the assembling of the body sections into an assembled structure or a packed structure can be carried out by one or more movement means, such as motors. For example, after the locking blocks 52, 54 have been released from the cam locking assembly 70 (see FIG. 16), a motor 190 can be used to move the locking block 54 away from the locking block 52 so that the second body section 30 is moved toward the first body section 20 for packing as indicated by the arrow 130, as shown in FIG. 18.

Figure 19A:
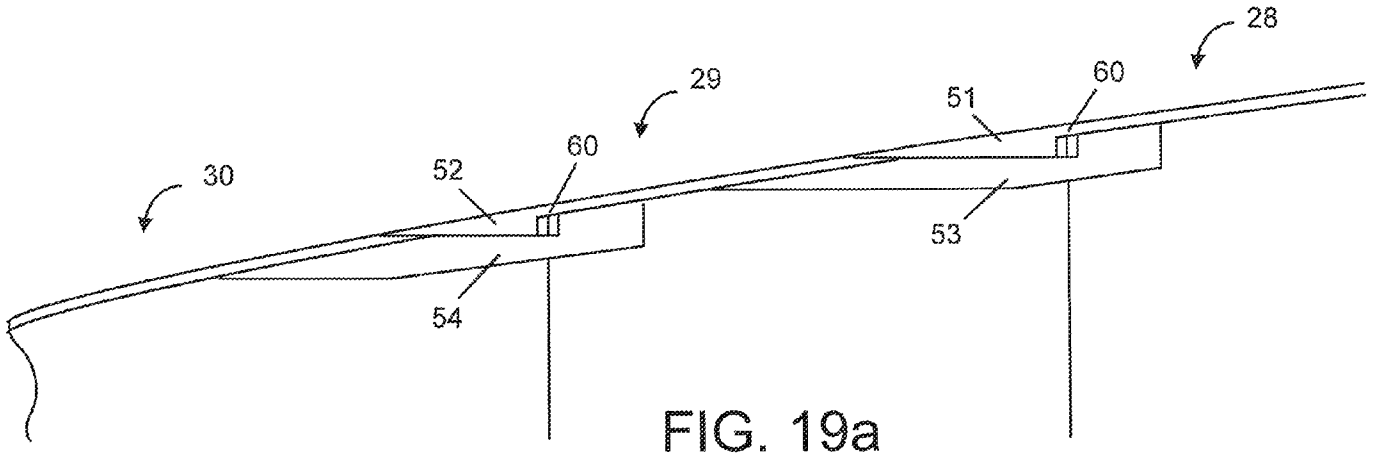
FIG. 19*a* shows three adjacent body sections of the watercraft.
Figure 19B:
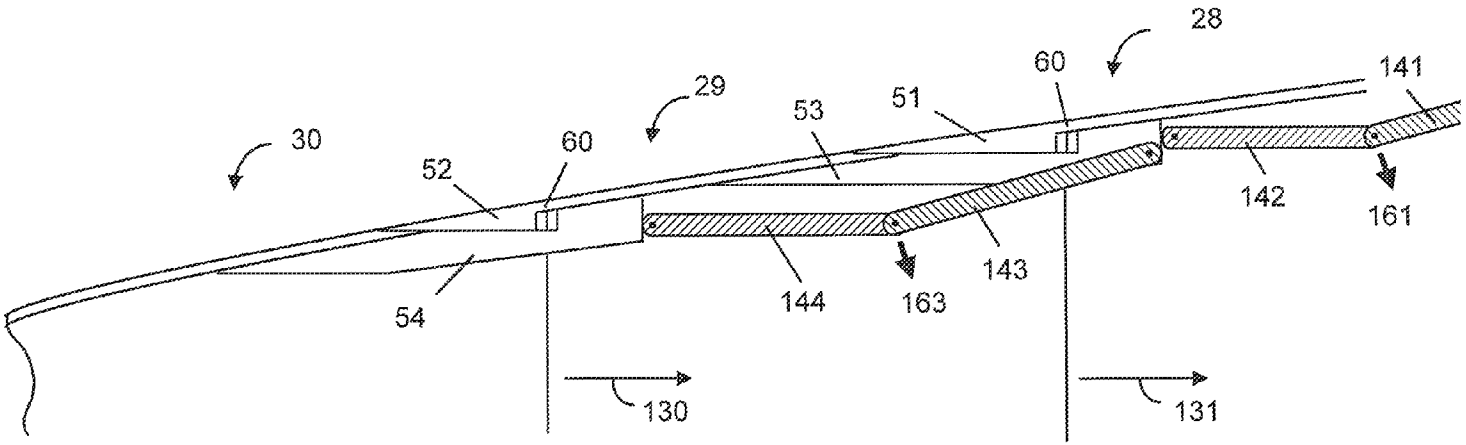
FIGS. 19*b*-19*d* illustrate how two adjacent body sections are folded, according to a different embodiment of the present invention.
Figure 19C:
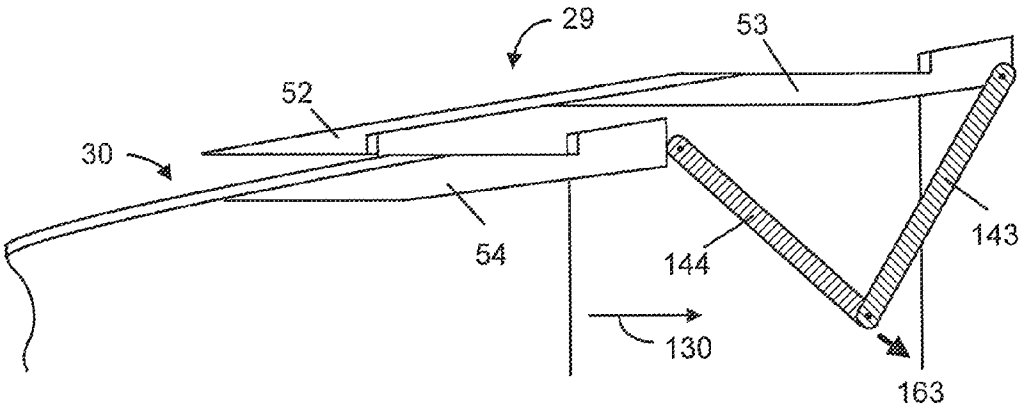
Figure 19D:
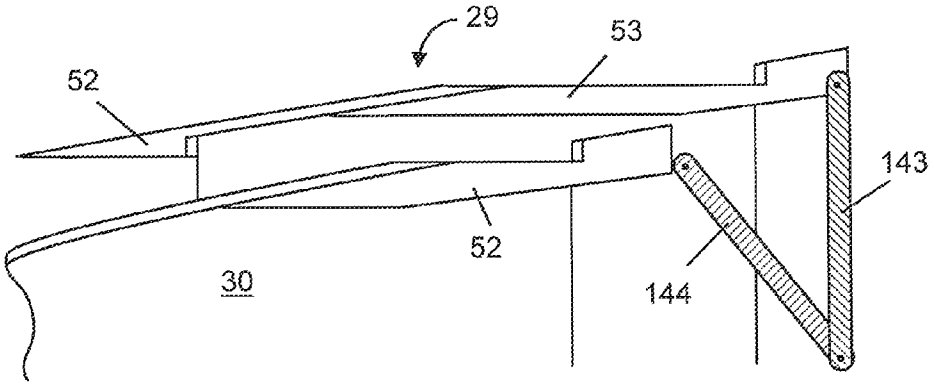

FIG. 19*a* shows three adjacent body sections of a sectional watercraft, similar to those shown in FIG. 14. As shown in FIG. 19*a*, the three adjacent body sections are sections 28, 29 and 30. Part of the body section 28 has a locking block 51 to be engaged with a locking block 53 of the body section 29. Part of the body section 29 has a locking block 52 to be engaged with a locking block 54 of the body section 30. As such, the body section 30 can be slid into the body section 29, which can also be slid into the body section 28 to form a packed structure, for example. In one embodiment of the present invention, two adjacent body sections are linked with foldable arms for packing purposes. As shown in FIG. 19*b*, the body sections 29, 30 are linked by a pair of foldable arms 143, 144 and the body sections 28, 20 are linked by a pair of foldable arms 141, 142. When the foldable arms 143, 144 are moved along the direction 163, the body section 30 can be moved toward the body section 29 along the direction 130. Likewise, when the foldable arms 141, 142 are moved along the direction 161, the body section 29, together with body section 30, can be moved toward the body section 28 along the direction 131. FIGS. 19*c* and 19*d* show how the body section 30 is further moved into the body section 29. It should be noted that the folding of the arm pair 141, 142 and the arm pair 143, 144 can be carried out by a motor or other movement means.

Figure 20A:
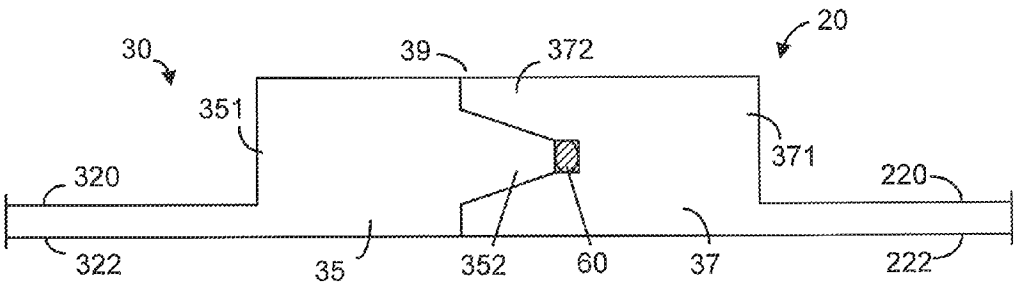
FIG. 20*a* illustrates how two adjacent body sections are mated and sealed.
Figure 20B:
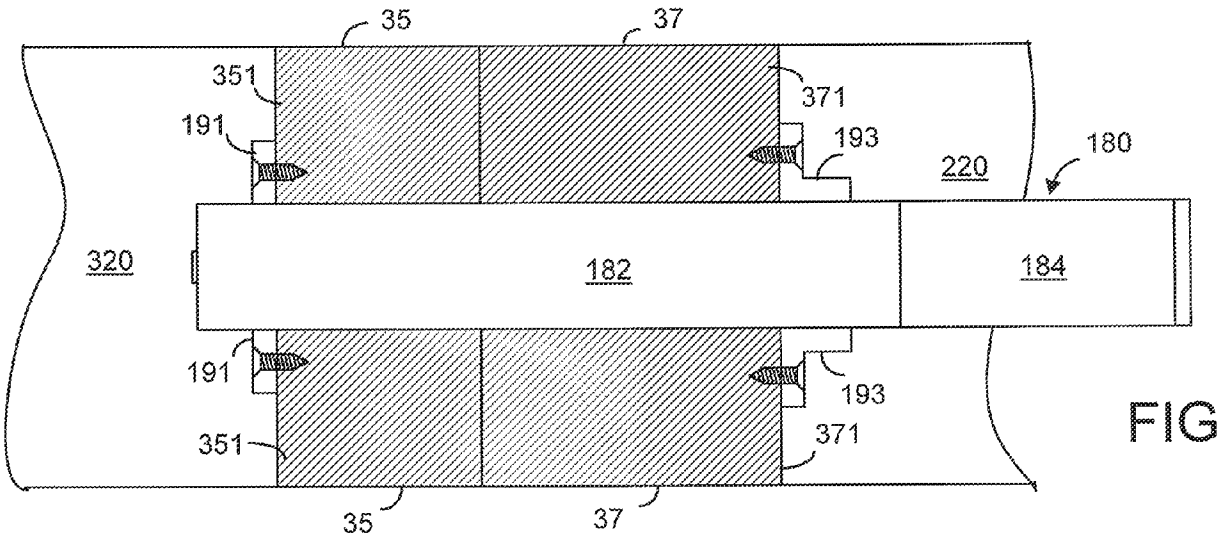
FIGS. 20*b*-20*g* illustrate how the two adjacent body sections are locked and separated, according to one embodiment of the present invention
Figures 20C, 20D, 20E:
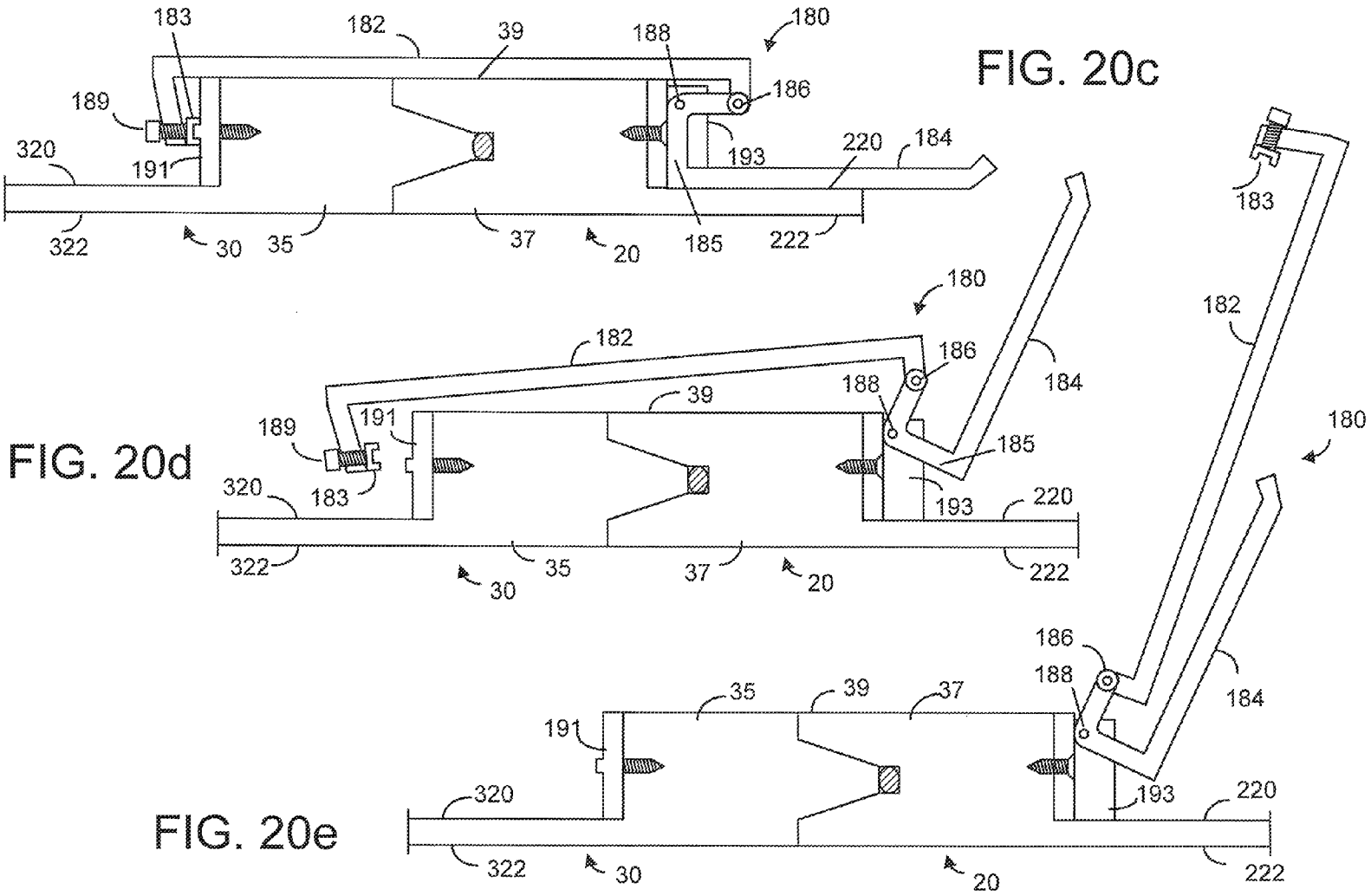

In a different embodiment of the present invention, two adjacent body sections are clamped by a locking clamp when the watercraft is in an assembled structure. The locking clamp can be released so as to separate the two adjacent body sections one from another, when needed. To illustrate this different embodiment, the two adjacent body sections 20 and 30 as shown in FIGS. 1 and 2 are used to demonstrate how the locking clamp can be applied on these two body sections. As shown in FIG. 20*a*, the first body section 20 has a mating block 37 to face with a mating block 35 of the second body section 30. Mating block 35 is substantially flush with the exterior surface 322 of the second body section 30 but extended further into the interior of the second body section 30 as indicated by the interior surface 320. Likewise, mating block 37 is substantially flush with the exterior surface 222 of the first body section 20 but extended further into the interior of the first body section 20 as indicated by the interior surface 220. The interior sides of mating blocks 35 and 37 provide a surface 39 to support a locking clamp 180 as shown in FIGS. 20*b* and 20*c*. Mating block 35 has a first end 351 and an opposing second end 352. Mating block 37 has a first end 371 and an opposing end 372. The second end 352 of mating block 35 has a tongue configured to be engaged with a groove on the second end 372 of mating block 37. A sealing part 60, which can be a neoprene O-ring, for example, is secured between the tongue and the groove. As shown in FIGS. 20*b* and 20*c*, a latch bracket 191 is secured to the first end 351 of mating block 35 and a clamp mount 193 is secured to the first end 371 of mating block 37. As shown in FIG. 20*c*, locking clamp 180 has two clamp parts 182, 184 rotatably connected to each other by a pin 186. As shown in FIGS. 20*c* to 20*g*, clamp part 184 is rotatably mounted on clamp mount 193 by a pivot 188. Clamp part 182 has two opposing ends, one end is connected to clamp part 184 and the other end has a locking cup 183 configured to be engaged with latch bracket 191 via a tension adjustment screw 189. Clamp part 184 has a folded section 185 adjacent to clamp mount 193. When locking clamp 180 is used to keep mating blocks 35 and 37 in a locked position, clamp part 182 is lowered so that locking cup 183 is fully engaged with latch bracket 191. As clamp part 184 is pushed toward the interior surface 222 of the first body section 20, folding section 185 presses against mating block 37 while clamp part 182 rests on surface 39 as shown in FIG. 20*c*. With tension adjustment screw 189 being properly adjusted, clamp part 184 applies an urging force on mating block 37 against mating block 35 so as to keep the first body section 20 and the second body section 30 in a locked position.

Figure 20F:
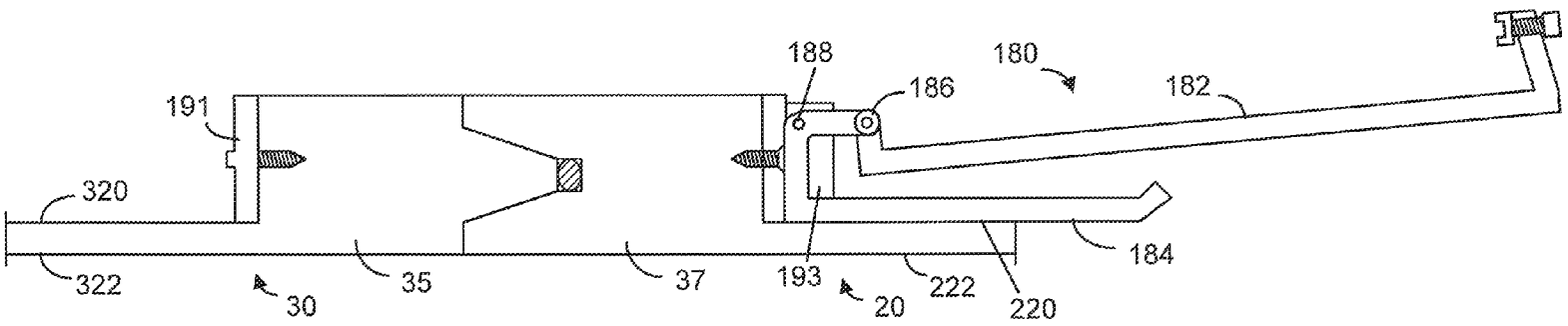
Figure 20G:
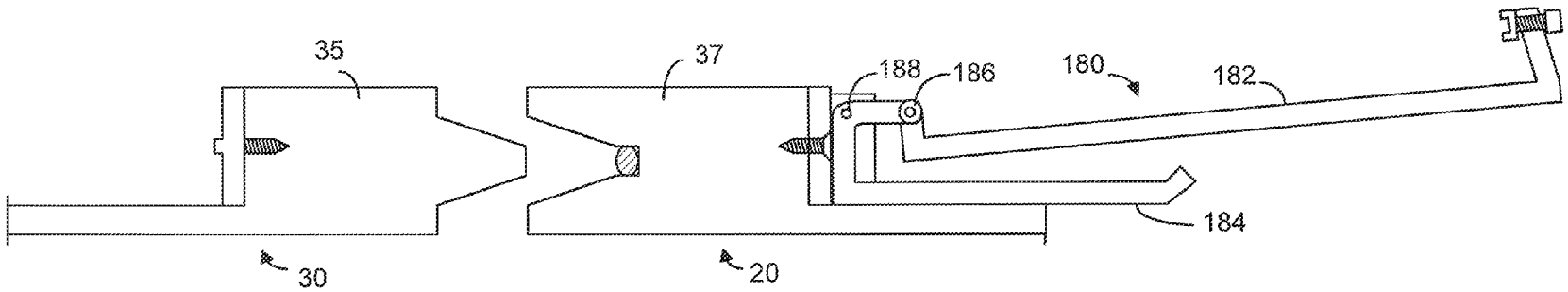

To separate the first body section 20 from the second body section 30, clamp part 184 is rotated away from the interior surface 220 so as to disengage locking cup 183 of clamp part 182 from latch bracket 191, as shown in FIG. 20*d*. Clamp part 182 can then be rotated further away from surface 39 toward clamp part 184 as shown in FIG. 20*e*. As both clamp parts 182 and 184 are lowered towards the interior surface 222 as shown in FIG. 20*f*, clamp part 182 can be used to pull mating part 37 away from mating part 35, as shown in FIG. 20*g*.

According to various embodiments of the present invention, the watercraft has two or more body sections. In some of the embodiments, two adjacent body sections are taken apart before the smaller one of the adjacent sections can be placed into the larger one. In some of the embodiments, two adjacent body sections can be packed into a smaller size without being taken apart. Likewise, when the watercraft has three or more body sections, it is also possible to slide the sections on the two ends inward to form a packed size without being taken apart. But there are many more ways to pack the body sections, depending upon how the body sections are dimensioned.

Thus, although the present invention has been described with respect to one or more embodiments thereof, it will be understood by those skilled in the art that the foregoing and various other changes, omissions and deviations in the form and detail thereof may be made without departing from the scope of this invention.

What is claimed is:

1. A watercraft comprising:

a plurality of separable body sections configured for assembling into a single assembled structure having a first length, and for packing into a packed structure having a second length smaller than the first length, said plurality of separable body sections comprising a first body section and a second body section, the first body section comprising an exterior surface and an interior surface defining a cavity with an opening, wherein the second body section is dimensioned such that at least part of the second body section is locatable inside the cavity of the first body section to form the packed structure, wherein the first body section comprises a first inner end, an opposing first outer end and a first intermediate portion between the first inner end and the first outer end, and the second body section comprises a second inner end, an opposing second outer end and a second intermediate portion between the second inner end and the second outer end, and wherein the second inner end is adjacent to the first inner end when said plurality of separable body sections form the single assembled structure, wherein the second outer end and at least part of the second intermediate portion are locatable inside the cavity when said plurality of separable body sections form the packed structure, the watercraft further comprising:

a locking assembly configured for securing the first inner end to the second inner end when said plurality of separable body sections form the single assembled structure, wherein the locking assembly comprises:

a first mating block secured to the first inner end;

a second mating block secured to the second inner end; and a locking clamp comprising a first clamp part and a second clamp part, the first clamp part comprising a first end and an opposing second end, the second clamp part comprising a first end and an opposing second end, wherein the second end of the first clamp part is rotatably connected to the first end of the second clamp part, and the first end of the second clamp part is rotatably mounted on the second mating block, wherein when the locking clamp is operated in the first position, the first end of the first clamp part is caused to engage with the first mating block and the second end of the second clamp part is configured to apply an urging force on the second mating block against the first mating block for securing the first inner end to the second inner end; and when the locking clamp is operated in the second position, the first end of the first clamp part is disengaged from the first mating block, allowing the second mating block to be separated from the first mating block.

* * * * *